US008354898B2

(12) United States Patent
Iio et al.

(10) Patent No.: US 8,354,898 B2
(45) Date of Patent: Jan. 15, 2013

(54) HARMONIC SUPPRESSION RESONATOR, HARMONIC PROPAGATION BLOCKING FILTER, AND RADAR APPARATUS

(75) Inventors: Ken'ichi Iio, Nishinomiya (JP); Mitsuru Makihara, Nishinomiya (JP); Hiroshi Nagata, Nishinomiya (JP); Yoshinobu Hashimoto, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 972 days.

(21) Appl. No.: 12/343,267

(22) Filed: Dec. 23, 2008

(65) Prior Publication Data

US 2009/0201106 A1 Aug. 13, 2009

(30) Foreign Application Priority Data

Dec. 28, 2007 (JP) ..... 2007-340542
Dec. 28, 2007 (JP) ..... 2007-340560
Sep. 18, 2008 (JP) ..... 2008-238947

(51) Int. Cl.
*H01P 7/06* (2006.01)

(52) U.S. Cl. ..... 333/230; 333/212

(58) Field of Classification Search ..... 333/211, 333/227, 208, 212, 135, 230, 202
See application file for complete search history.

(56) References Cited

U.S. PATENT DOCUMENTS 3,593,220 A * 7/1971 Rooney ..... 333/211
3,805,193 A * 4/1974 Mohr ..... 333/211
4,060,778 A * 11/1977 Hefni et al. ..... 333/211
4,096,457 A * 6/1978 Snyder ..... 333/208
5,243,309 A * 9/1993 L'Ecuyer ..... 333/209
5,495,216 A 2/1996 Jachowski
2002/0060616 A1 5/2002 Jang
2002/0180559 A1 12/2002 Jang
2004/0183627 A1* 9/2004 Lo Hine Tong et al. ..... 333/212

FOREIGN PATENT DOCUMENTS

EP 0 320 268 A1 5/1989
GB 2456043 B * 11/2011

(Continued)

OTHER PUBLICATIONS

Japanese Office Action dated Aug. 21, 2012 for Japanese Application No. 2008-238947.

*Primary Examiner* — Dean O Takaoka
*Assistant Examiner* — Alan Wong
(74) *Attorney, Agent, or Firm* — Birch, Stewart, Kolasch & Birch, LLP

(57) ABSTRACT

A harmonic suppression resonator comprises a plurality of waveguide resonators that resonate in TE mode, in which harmonic suppression resonator, adjoining resonators are coupled via a plurality of coupling windows. Four coupling windows 33*bc*1, 33bc2, 33*bc*3 and 33*bc*4 are provided between a resonant region 51*b* and a resonant region adjoining the resonant region 51*b*. These coupling windows allow fundamental wave modes of the adjoining resonators to be coupled mainly by magnetically coupling. The coupling windows 33*bc*3 and 33*bc*4 allow second harmonic modes of the adjoining resonators to be electrically coupled, and the coupling windows 33*bc*1 and 33*bc*2 allow the second harmonic modes of the adjoining resonators to be magnetically coupled. By causing the amount of the electrically coupling and the amount of the magnetically coupling to be substantially equal, the coupling of the second harmonic modes is negated, whereby propagation of the second harmonic is blocked.

15 Claims, 24 Drawing Sheets

FOREIGN PATENT DOCUMENTS

| | | | |
|---|---|---|---|
| JP | 54-103655 | A | 8/1979 |
| JP | 5-85103 | A | 11/1993 |
| JP | 2000-216602 | A | 8/2000 |
| JP | 2001-136005 | A | 5/2001 |
| JP | 2001-196808 | A | 7/2001 |
| JP | 2002-76716 | A | 3/2002 |
| JP | 2003-298319 | A | 10/2003 |
| JP | 2003-304106 | A | 10/2003 |
| JP | 2004-64577 | A | 2/2004 |

* cited by examiner (A)

(B)

(A)
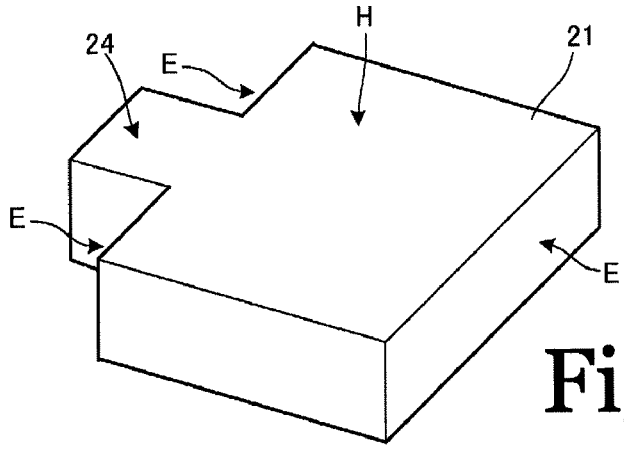
Fig.10(A)
Fig.10(B)
(B)
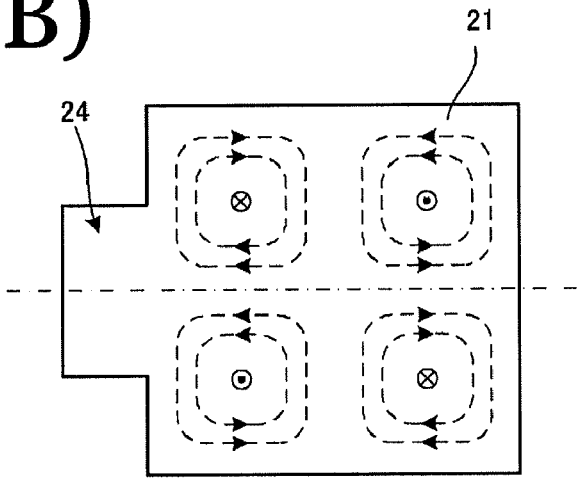
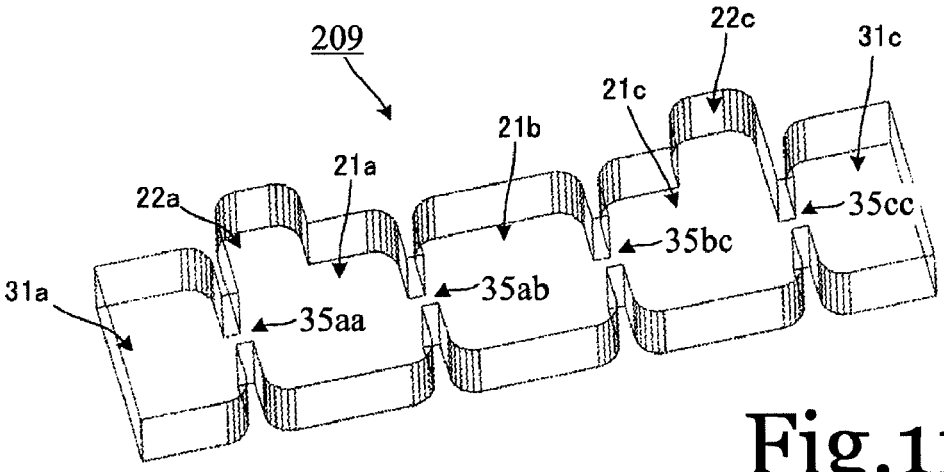
Fig.11

(A)

(B)

HARMONIC SUPPRESSION RESONATOR, HARMONIC PROPAGATION BLOCKING FILTER, AND RADAR APPARATUS

CROSS-REFERENCE TO RELATED APPLICATION(S)

This application claims priority under 35 U.S.C. §119 to Japanese Patent Application No. 2007-340542 which was filed on Dec. 28, 2007, Japanese Patent Application No. 2007-340560 which was filed on Dec. 28, 2007, and Japanese Patent Application No. 2008-238947 which was filed on Sep. 18, 2008, the entire disclosure of which is hereby incorporated by reference.

BACKGROUND OF THE INVENTION

1. Field of the Invention

The present invention relates to a harmonic suppression resonator for suppressing, in a circuit using high frequency signals, a harmonic component having a different frequency from a fundamental wave frequency. The present invention also relates to a high-frequency device such as a harmonic propagation blocking filter, radar apparatus or the like, which comprises the harmonic suppression resonator.

2. Description of the Background Art

Conventionally, for the purpose of efficient use of radio wave resources, high-frequency devices are regulated and recommended so as not to cause unnecessary radiation in a frequency band which is remote from a frequency band used by the high-frequency devices.

Japanese Laid-Open Patent Publication No. 2004-274341 (hereinafter, referred to as Patent Document 1) describes a band-pass filter for improving a spurious characteristic of a microwave generating source.

FIG. 1 shows a structure of a waveguide band-pass filter of Patent Document 1. In the waveguide band-pass filter, waveguide resonators 1001*a* and 1001*b*, which have TE102 mode that is a fundamental mode of a rectangular waveguide, are provided so as to be connected to each other in a direction in which an electric field component E is orthogonal to a main propagation direction of TE10 mode that is a fundamental mode of a rectangular waveguide. The waveguide resonators 1001*a* and 1001*b* are connected such that a wide face, which is one of waveguide walls, of each waveguide resonator, is connected to the wide face of the other waveguide resonator so as to form a two-part structure. A turnaround section 1005 is provided at the connection between both the waveguide resonators 1001*a* and 1001*b*, which connection is a part of the connected waveguide resonators 1001*a* and 1001*b*. A coupling hole 1002*a* for coupling the waveguide resonators 1001*a* and 1001*b* is provided at a waveguide wall 1006 of the turnaround section 1005, which waveguide wall 1006 is formed by the wide waveguide faces dividing the waveguide resonators 1001*a* and 1001*b*. Input/output coupling holes 1003*a* and 1003*b*, which are respectively formed at one end and the other end of the connected waveguide resonators 1001*a* and 1001*b*, are separated from each other by the waveguide wall 1006 formed with the wide faces of the waveguide resonators 1001*a* and 1001*b*, and do not couple with each other. Input/output waveguides 1004*a* and 1004*b* are respectively connected, in a direction orthogonal to an electric field component, to the input/output coupling holes 1003*a* and 1003*b* that are respectively formed at one end and the other end of the connected waveguide resonators 1001*a* and 1001*b*.

Another technique for suppressing unnecessary radiation contained in radio waves radiated from a radar using a large amount of power, is disclosed by Japanese Laid-Open Patent Publication No. 2007-81856 (hereinafter, referred to as Patent Document 2).

For a transmitter tube of a shipboard radar, a magnetron is used. The magnetron basically oscillates in π mode to generate a microwave having a fundamental wave frequency. At the same time, however, a frequency component of π-1 mode and a frequency component of a frequency-doubled wave (i.e., a second harmonic) occur as unnecessary radiation. In Patent Document 2, in order to suppress this unnecessary radiation, a rotary joint of a pedestal section is used, in which a spurious suppression filter (LPF) is provided in a coaxial tube on a central axis of the rotary joint.

In general, in a high-frequency device using a waveguide as a transmission path, a waveguide resonator is provided as a filter in order to allow only a fundamental wave component to propagate.

Further, Japanese Laid-Open Patent Publications No. 2004-274341 (hereinafter, referred to as Patent Document 3) and No. 2007-81856 (hereinafter, referred to as Patent Document 4) disclose techniques in which metallic blocks, which are obtained from dividing a metallic block along a longitudinal plane thereof, are combined to form a waveguide. Although this type of waveguide has advantages in manufacturing, it is necessary to provide a countermeasure for radio wave leakage (electrical loss) from a gap between planes, which face each other, of the combined metallic blocks. Patent Document 3 proposes to interpose a soft metallic foil between a metallic block, on which a waveguide groove is formed, and a metallic block, which covers the groove. In this manner, a gap between portions, which face each other, of the metallic blocks is eliminated by a tight contact between the metallic foil and the metallic blocks. Patent Document 4 proposes to silver-plate a vicinity of a groove of a plane of one metallic block, which plane faces a plane of the other metallic block, or to form a protrusion by using a metallic block or a different member, whereby a gap between the facing planes of the blocks is eliminated.

As mentioned above, a magnetron is used for a transmitter tube of a shipboard radar. The magnetron basically oscillates in π mode to generate a microwave having a fundamental wave frequency. At the same time, however, a frequency component of π−1 mode and a frequency component of a frequency-doubled wave (i.e., a second harmonic) occur as unnecessary radiation.

In a structure comprising a waveguide resonator as a filter, if a waveguide filter, which resonates in, for example, TE101 mode of a rectangular waveguide, is provided, not only a fundamental wave is transmitted but also a second harmonic is transmitted since the waveguide filer also resonates in TE202 mode. For this reason, it has been impossible to use a waveguide filter as a harmonic propagation blocking filter. This is described below using FIG. 2.

FIG. 2 shows a structure of a conventional waveguide resonator that does not have a harmonic-suppressing function. FIG. 2(A) is an external perspective view of the conventional waveguide resonator. Basically, the waveguide resonator has a shape which is formed in the following manner: a rectangular waveguide is cut such that wide planes thereof become square planes; and front and rear openings thereof are closed using conductive materials.

FIG. 2(B) schematically shows electromagnetic field distribution of a fundamental wave. FIG. 2(D) schematically shows electromagnetic field distribution of a second harmonic. Here, solid arrows represent lines of electric force at a given moment, and dot marks and cross marks represent directions of magnetic fields. In this manner, electromagnetic field intensity distribution is represented.

FIG. 2(C) shows, in relation to the electromagnetic field distribution of the fundamental wave, intensity distribution of electric field energy and magnetic field energy. FIG. 2(E) shows, in relation to the electromagnetic field distribution of the second harmonic, intensity distribution of electric field energy and magnetic field energy. In these diagrams, EF represents a region where the electric field energy is dominant, and MF represents a region where the magnetic field energy is dominant.

As shown herein, the waveguide resonator that resonates in the TE101 mode also resonates in the TE202 mode. Therefore, the second harmonic in the case where the fundamental wave is in the TE101 mode, cannot be suppressed.

Accordingly, even if the waveguide band-pass filter disclosed by Patent Document 1 is used in order to suppress the aforementioned unnecessary radiation, there is a problem that an effect to suppress the second harmonic component, which is crucial, is low.

In such a structure as disclosed in Patent Document 2 where a low-pass filter is used, harmonic components can be suppressed over a relatively wide frequency band within a frequency band that is higher than a fundamental wave frequency band. However, there is a problem that an attenuation characteristic in the frequency band higher than the fundamental wave frequency band is not steep, and an effect to suppress the second harmonic, which is crucial, is low.

Further, in the structure comprising a waveguide resonator as a filter, if a waveguide filter, which resonates in, for example, TE□101 mode of a rectangular waveguide (hereinafter, simply referred to as "TE101 mode"), is provided, not only a fundamental wave is transmitted but also a second harmonic is transmitted since the waveguide filter also resonates in TE□202 mode (hereinafter, simply referred to as "TE202 mode"). For this reason, it has been impossible to use a waveguide filter as a harmonic propagation blocking filter. This is described below with reference to FIG. 2.

FIG. 2 shows a configuration of a conventional waveguide resonator that does not have a harmonic-suppressing function. FIG. 2(A) is an external perspective view of the conventional waveguide resonator. Basically, the waveguide resonator has a shape which is formed in the following manner: a rectangular waveguide is cut such that wide planes thereof become square planes; and front and rear openings thereof are closed using conductive materials.

FIG. 2(B) schematically shows electromagnetic field distribution of a fundamental wave. FIG. 2(D) schematically shows electromagnetic field distribution of a frequency-doubled wave of the fundamental wave. Here, solid arrows represent lines of electric force at a given moment, and dot marks and cross marks represent directions of magnetic fields. In this manner, electromagnetic field intensity distribution is represented.

As shown herein, the waveguide resonator that resonates in the TE101 mode also resonates in the TE202 mode. Therefore, the second harmonic in the case where the fundamental wave is in the TE101 mode, cannot be suppressed.

Further, in Patent Document 3, since the soft metallic foil is used, the foil needs to be handled carefully, and it is questionable whether flatness or the like of the foil can be maintained in the long term. Thus, the technique disclosed in Patent Document 3 is not sufficient in terms of workability and reliability. Still further, in Patent Document 4, a new problem arises in relation to flatness of a surface of the formed protrusion, and thus, there is a limit to completely eliminate the gap.

SUMMARY OF THE INVENTION

Therefore, an object of the present invention is to provide a harmonic suppression resonator having a high harmonic-suppression effect, and to provide a harmonic suppression high frequency device comprising the same.

The present invention has the following features to attain the object mentioned above. A first aspect of the present invention is a harmonic suppression resonator comprising a plurality of waveguide resonators which resonate in TE mode, the harmonic suppression resonator having adjoining resonators therein coupled with each other via a coupling window.

In the harmonic suppression resonator, harmonic modes of a predetermined order of the adjoining resonators are magnetically and electrically coupled with each other via the coupling window, whereby coupling of the harmonic modes is negated.

According to this structure, the harmonic modes are not coupled. Even if, between the adjoining two resonators, a fundamental wave of one resonator and a harmonic of the other resonator are coupled via the coupling window, the harmonic modes of the adjoining two resonators are negated due to the above magnetically and electrically coupling. Accordingly, propagation in the harmonic modes is blocked.

In this manner, an n-th order harmonic to be suppressed can be effectively suppressed, and propagation of an unnecessary harmonic can be blocked substantially.

In a second aspect of the present invention based on the first aspect, a plurality of coupling windows are provided, and fundamental wave modes of the adjoining resonators are mainly electrically coupled or magnetically coupled with each other via a part or all of the plurality of coupling windows.

According to this structure, coupling of the harmonic modes is blocked by means of the coupling windows that allow the fundamental wave modes of the adjoining resonators to be coupled. Accordingly, propagation in the harmonic modes is blocked.

In a third aspect of the present invention based on the first aspect: a coupling window for causing the harmonics of the adjoining resonators to be magnetically coupled with each other, may be provided; an additional region, whose width is no longer than a half wavelength of the fundamental wave and no shorter than a half wavelength of the harmonics, may be provided at any position on an E-plane of at least one of the plurality of waveguide resonators; and a coupling window for causing the harmonics to be electrically coupled with each other may be provided near the additional region.

According to this structure, the harmonics of the adjoining resonators are relatively strongly electrically coupled via the coupling window provided near the additional region. Accordingly, magnetically coupling via the other coupling window is negated, and thus, coupling of the harmonics is more securely suppressed.

If, without providing the additional region, a coupling window is provided in such a position as to allow the harmonic modes to be electrically coupled, the position of the coupling window is in an area where electric field intensity of the fundamental wave modes is high. Accordingly, electric discharge is likely to occur at an opening of the coupling window or between the coupling window and a conductor side facing the coupling window, that is, power-withstanding capability deteriorates. However, the above-described structure does not cause this problem.

In a fourth aspect of the present invention based on the first aspect, in the harmonic suppression resonator, at least one of the plurality of waveguide resonators, which respectively include the resonant regions and in each of which the fundamental wave resonates in the TE mode, includes an additional region in which the fundamental wave is blocked and whose size is such that an n-th order harmonic to be suppressed [n is an integer no less than 2] is propagated therein.

According to this structure, the additional region does not affect the fundamental wave. Therefore, a resonance frequency of the fundamental wave does not vary. However, a resonance frequency of the n-th order harmonic lowers. Accordingly, the n-th order harmonic (n-multiplication wave) to be suppressed does not resonate at a resonance frequency of an n-th order harmonic (n-times frequency wave) of the resonators. In other words, the harmonic suppression resonator acts as a harmonic suppression resonator that resonates at the fundamental wave and which does not resonate at the harmonic to be suppressed.

In a fifth aspect of the present invention based on the fourth aspect, the resonant regions respectively act as substantially rectangular waveguide resonators, in each of which the fundamental wave resonates in the TE mode. The additional region has such a shape as to protrude from an E-plane of at least one of the substantially rectangular waveguide resonators such that a width, along a longitudinal direction of the E-plane, of the additional region is no longer than ½ of a wavelength of the fundamental wave and no shorter than ½ of a wavelength of the n-th order harmonic, and a depth of the additional region is different from m/2 of the wavelength of the n-th order harmonic [m is an integer no less than 1].

According to this structure, the n-th order harmonic to be suppressed can be effectively suppressed, and thus the unnecessary harmonic can be substantially suppressed.

In a sixth aspect of the present invention based on the fifth aspect, the depth of the additional region is set to be, in particular, substantially (1+2 m)/4 of the wavelength of the n-th order harmonic [m is an integer no less than 0].

According to this structure, the n-th order harmonic to be suppressed can be suppressed more effectively, and thus the unnecessary harmonic can be substantially suppressed. Further, a size of the additional region can be kept small, which prevents the harmonic suppression resonator from becoming large sized.

In a seventh aspect of the present invention based on the fourth aspect, the additional region is provided such that a center of the additional region is positioned so as to deviate from an extension of a line that connects centers, in a longitudinal direction, of E-planes of at least one of the resonant regions.

As a result, an n-th order harmonic standing wave easily occurs in the additional region, and a harmonic suppression effect is improved, accordingly.

In an eighth aspect of the present invention based on the first aspect, the plurality of waveguide resonators constitute a waveguide structure comprising a first block which is a metallic block and whose predetermined face has a radio-wave-propagating groove formed thereon, and the predetermined face of the first block is covered by a cover member, and a plurality of first protrusions are formed, on the predetermined face, in positions along the groove with predetermined pitches.

According to the eighth aspect, by covering the predetermined face of the first block with the cover member, a wave guide is formed in which a space, which is formed with the groove of the first block and the cover member, acts as a waveguide path. When the groove of the first block is covered with the cover member, the protrusions formed on the predetermined face are deformed in accordance with relative strength between the first block and the cover member, whereby the first block and the cover member tightly contact each other. In this manner, a gap between the first block and the cover member is eliminated, and radio wave leakage is prevented to the utmost extent.

In a ninth aspect of the present invention based on the eighth aspect, the cover member is formed from a material that is as hard as, or softer than, the first block.

According to this structure, a degree of contact between the first block and the cover member is increased due to deformation of a surface of the relatively soft cover member. As a result, the gap between the first block and the cover member is eliminated, whereby radio wave leakage is prevented to the utmost extent.

In a tenth aspect of the present invention based on the eighth aspect, the harmonic suppression resonator comprises a second block which is a metallic block provided to be positioned at an opposite side to the first block with respect to the cover member interposed between the second block and the first block and which has a radio-wave-propagating groove formed on a face thereof facing the cover member. The second block has a plurality of second protrusions, formed on the face thereof facing the cover member, in positions along the groove with predetermined pitches.

According to this structure, waveguides are respectively formed at both sides to the cover member, and the degree of contact between the first block and the cover member, as well as the degree of contact between the second block and the cover member, is increased. This consequently eliminates the gap between the first block and the cover member as well as the gap between the second block and the cover member. As a result, radio wave leakage from both the waveguides is blocked to the utmost extent.

In an eleventh aspect of the present invention based on the tenth aspect, the grooves formed on the first and second blocks are mirror-symmetrical to each other, and positions of the first protrusions and positions of the second protrusions deviate from each other by substantially half a pitch.

According to this structure, both the faces of the cover member are in tight contact with the protrusions, at substantially every half a pitch. As a result, radio wave leakage from both the grooves is blocked to the utmost extent.

In a twelfth aspect of the present invention based on the tenth aspect, holes are drilled through the first block, the second block and the cover member such that the holes at respective faces of the first block, the second block and the cover member are aligned, and the first block, the second block and the cover member are fastened together with fastening means through the holes.

According to this structure, the cover member is pressure-bonded to the first block and to the second block with a same required pressure by means of fastening means, for example, bolts and nuts, which required pressure is obtained by a degree of fastening.

In a thirteenth aspect of the present invention based on the tenth aspect, the first and second protrusions are swell portions surrounding recesses that are formed by pressing operations performed with a needle-like body.

According to this structure, the protrusions can be relatively easily formed by a so-called punching process.

A fourteenth aspect of the present invention is a harmonic propagation blocking filter comprising the harmonic suppression resonator and input/output sections for guiding a propagation signal into/out of the resonant regions.

By providing the harmonic propagation blocking filter, for example, in a path of a waveguide, propagation of the n-th order harmonic to be suppressed is blocked.

A fifteenth aspect of the present invention is a radar apparatus comprising: a magnetron which oscillates in π mode to generate the fundamental wave; an antenna; and the harmonic propagation blocking filter provided on a propagation path between the magnetron and the antenna.

According to this structure, a radio microwave generated by a microwave generator is propagated to the antenna while leakage thereof from the waveguide is blocked to the utmost extent. Thus, the microwave is efficiently transmitted into the air from the antenna.

These and other objects, features, aspects and advantages of the present invention will become more apparent from the following detailed description of the present invention when taken in conjunction with the accompanying drawings.

BRIEF DESCRIPTION OF THE DRAWINGS

FIG. 10 shows an example of a position in which an additional region of the harmonic suppression resonator is formed;

FIG. 11 is a perspective view showing a main part of a harmonic propagation blocking filter according to a fifth embodiment;

DESCRIPTION OF THE PREFERRED EMBODIMENTS

First Embodiment

Figure 3:
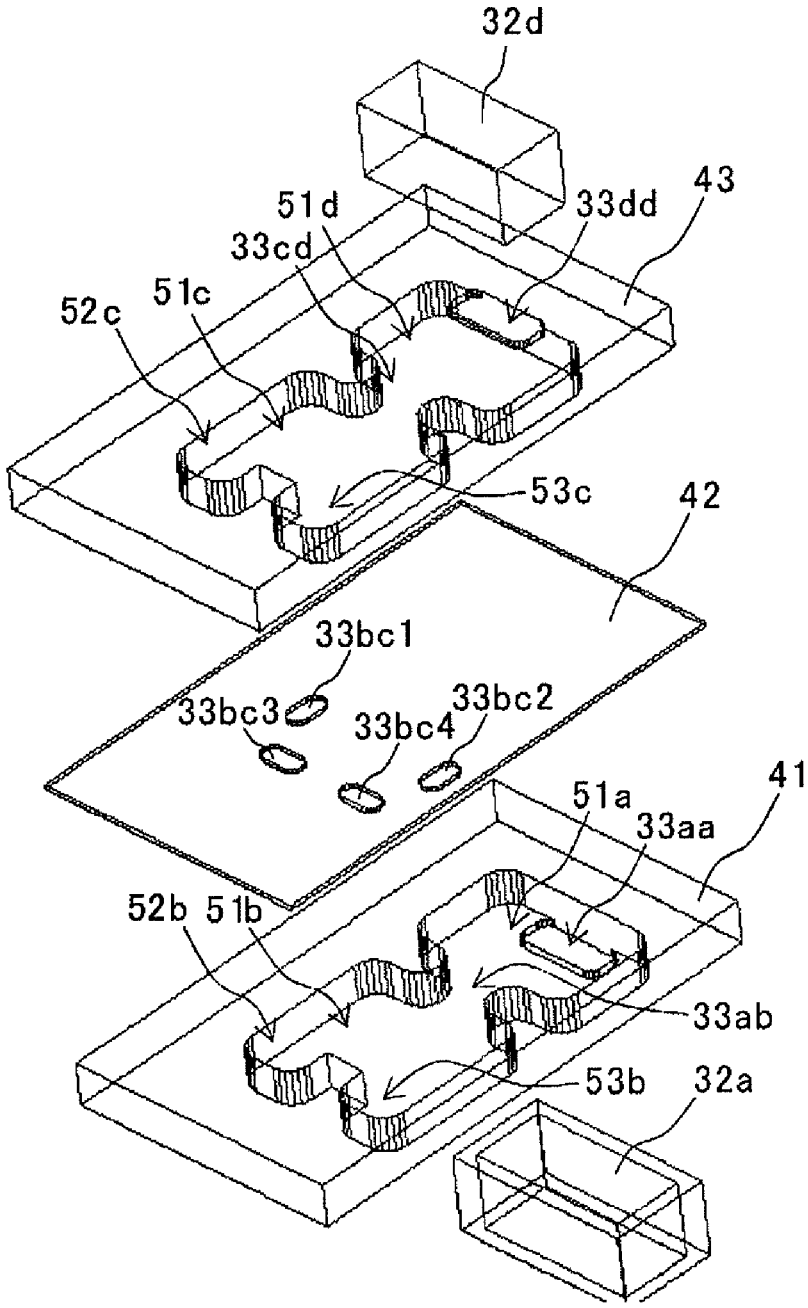
FIG. 3 is a perspective view showing a main part of a harmonic propagation blocking filter according to a first embodiment.

FIG. 3 is an exploded perspective view of a main part of a harmonic propagation blocking filter according to a first embodiment.

Basically, the harmonic propagation blocking filter comprises: two metallic blocks 41 and 43; a partition plate 42 provided between the two metallic blocks; and input/output spaces 32*a* and 32*d* (end portions of a rectangular waveguide).

Recessed portions having a predetermined depth are formed on the first metallic block 41, whereby resonant regions 51*a* and 511 are formed on the first metallic block 41. Additional regions 52*b* and 53*b* are provided at the resonant region 51*b*. Further, a coupling window 33*ab* is formed between the two resonant regions 51*a* and 51*b*. Also, a coupling window 33*aa* is formed at the resonant region 51*a* so as to be open to rearward of FIG. 3.

Resonant regions 51*c* and 51*d*, additional regions 52*c* and 53*c*, and coupling windows 33*cd* and 33*dd* are formed on the second metallic block 43 such that the structure of the second metallic block 43 is mirror-symmetrical to that of the first metallic block 41.

The partition plate 42 is a metallic plate interposed between resonant-region-forming planes of the metallic blocks 41 and 43, and have coupling windows 33*bc*1, 33*bc*2, 33*bc*3 and 33*bc*4 that are openings which allow the resonant regions 51*b* and 51*c* to communicate with each other.

The above five components are combined in a layered manner to form a harmonic propagation blocking filter 201.

Owing to the above structure, an electromagnetic wave is propagated through the following path: the input/output space 32*a*→the coupling window 33*aa*→the resonant region 51*a*→the coupling window 33*ab*→the resonant region 51*b*→the coupling windows 33*bc*→the resonant region

51*c*→the coupling window 33*cd*→the resonant region 51*d*→the coupling window 33*dd*→the input/output space 32*d*.

Figure 4A:
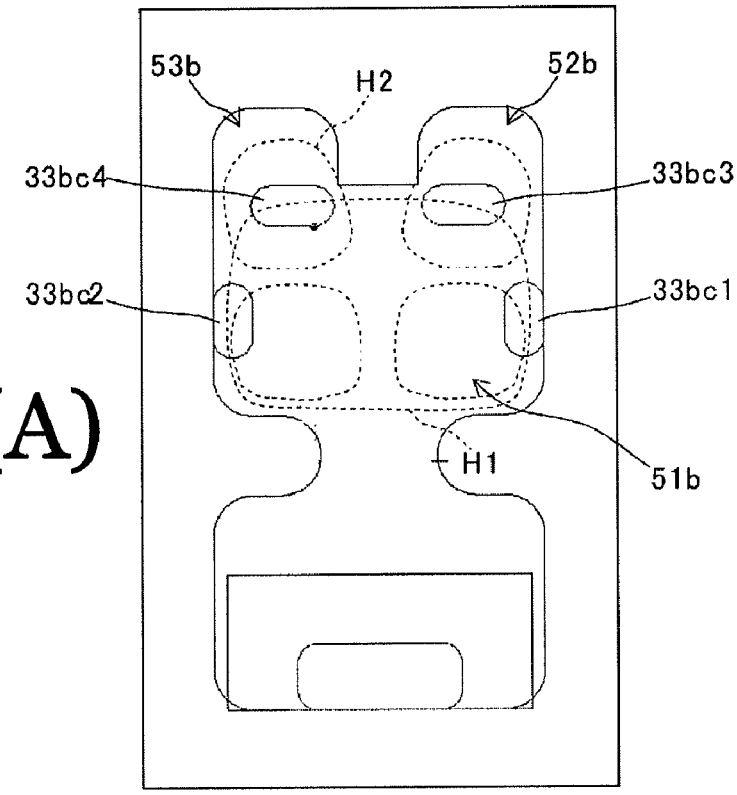
FIG. 4 shows a configuration of resonant regions and coupling windows of the harmonic propagation blocking filter according to the first embodiment, and shows an example of electromagnetic field distribution of each mode.
Figure 4B:
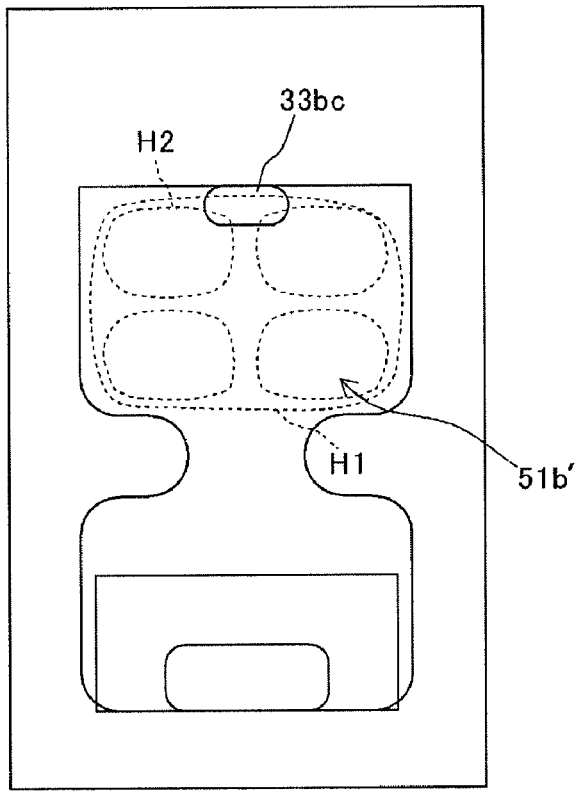

FIG. 4(A) shows an example of electromagnetic field distribution of each mode of predetermined resonators of the harmonic propagation blocking filter 201 according to the first embodiment, and FIG. 4(B) shows, for comparison with the harmonic propagation blocking filter 201, an example of electromagnetic field distribution of each mode of predetermined resonators of a filter.

Figure 5:
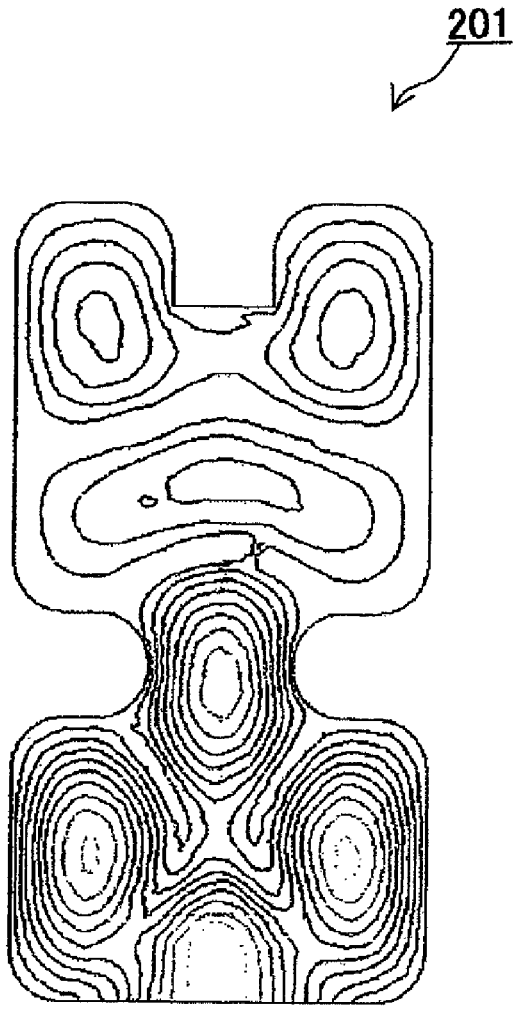
FIG. 5 shows an example of electromagnetic field distribution of a second harmonic mode of the harmonic propagation blocking filter according to the first embodiment.

FIG. 5 shows density distribution of second harmonic standing waves generated within the resonant regions of the harmonic propagation blocking filter 201 according to the first embodiment.

In the resonant region 51*b* and a resonant region 51*b*' shown in FIGS. 4(A) and 4(B), a loop H1 indicated by a dashed line represents a magnetic field loop in the electromagnetic field distribution of a fundamental wave mode, and four loops H2 indicated by dashed lines represent magnetic field loops in the electromagnetic field distribution of a second harmonic mode. Similarly, the electromagnetic field distributions of the fundamental wave mode and the second harmonic mode are present in a resonant region adjoining the resonant region 51*b* (i.e., the resonant region 51*c* shown in FIG. 3).

Also in the filter shown in FIG. 4(B) of the comparison example, similar magnetic fields of the fundamental wave mode and the second harmonic mode to those shown in FIG. 4(B) are distributed in a resonant region adjoining the resonant region 51*b*'.

In the filter of the comparison example, as shown in FIG. 4(B), a coupling window 33*bc* is positioned in an area where magnetic field energy of the fundamental wave modes of the adjoining resonators is high, the fundamental wave modes of the two resonators are magnetically coupled. In the area in which the coupling window 33*bc* is positioned, magnetic field energy of the second harmonic modes of the adjoining resonators is also relatively high. Accordingly, the second harmonic modes of the two resonators are magnetically coupled.

As a result, the filter shown in FIG. 4(B) of the comparison example resonates not only in the fundamental wave mode but also in the second harmonic mode, and the fundamental wave and the second harmonic are both propagated, accordingly.

Meanwhile, as shown in FIG. 4(A), in the harmonic propagation blocking filter according to the first embodiment, coupling windows 33*bc*1, 33*bc*2, 33*bc*3 and 33*bc*4 are positioned in areas in each of which magnetic field energy of the fundamental wave modes of the adjoining resonators is high. For this reason, the fundamental wave modes of the two resonators are strongly magnetically coupled with each other.

Figure 1:
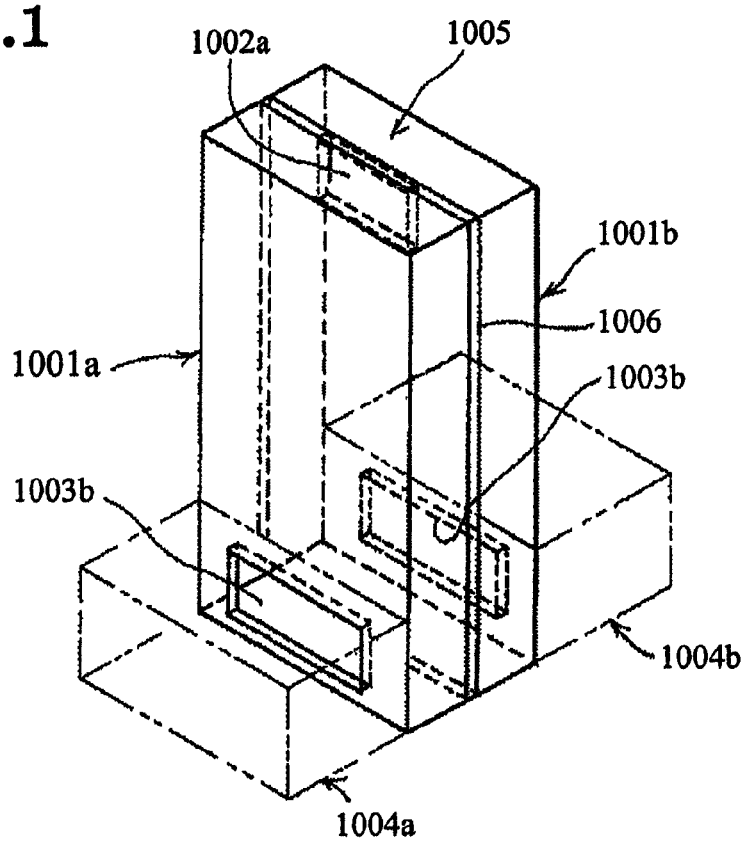
CONVENTIONAL ART Fig.1
FIG. 1 shows a structure of a waveguide band-pass filter of Patent Document 1.
Figure 2A:
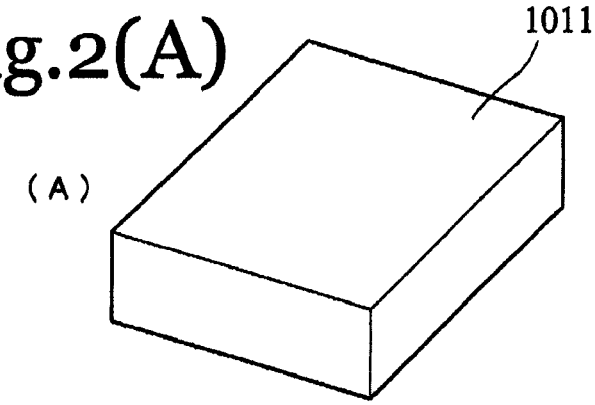
CONVENTIONAL ART Fig.2(A)
FIG. 2 shows a structure of a waveguide resonator and an example of electromagnetic field distributions of a fundamental wave mode and a second harmonic mode.
Figure 2B:
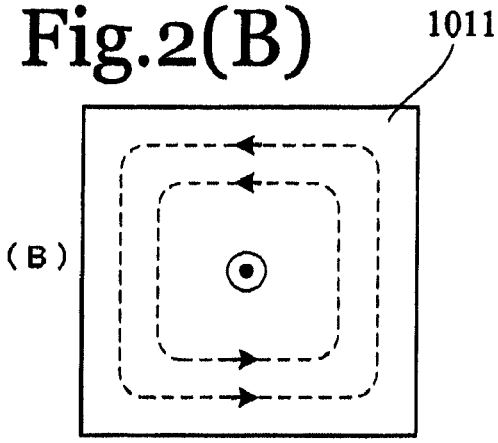
Figure 2C:
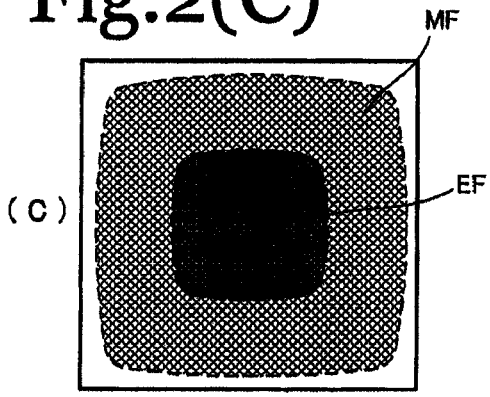
Figure 2D:
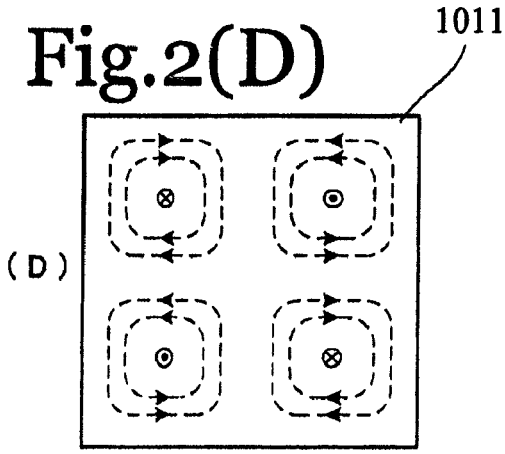
Figure 2E:
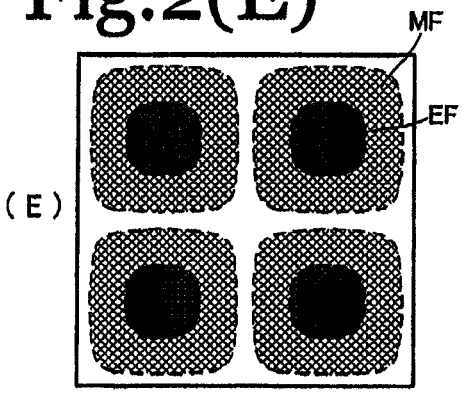

Since the coupling windows 33*bc*3 and 33*bc*4 are positioned in areas in each of which electric field energy of the second harmonic modes of the adjoining resonators is high, the second harmonic modes of the two resonators are prompted to be electrically coupled to each other. It is clear from the electromagnetic field distribution shown in FIGS. 2(E) and 5 that the coupling windows 33*bc*3 and 33*bc*4 are present in the areas in each of which the electric field energy of the second harmonic modes is high.

However, since the coupling windows 33*bc*1 and 33*bc*2 are positioned in the areas in each of which magnetic field energy of the second harmonic modes of the adjoining resonators is high. For this reason, the second harmonic modes of the two resonators are prompted to be magnetically coupled to each other. By causing the amount of the electric field coupling between the second harmonic modes and the amount of the magnetic field coupling between the second harmonic modes to be substantially equal, the second harmonic modes of the adjoining resonators are rarely coupled.

Note that, the aforementioned additional regions 52*b* and 53*b* (52*c* and 53*c*) each have such a shape as to be a partial protrusion of an E-plane of the resonant region 51*b* (51*c*) such that a width, in a longitudinal direction of the E-plane, of each additional region is no longer than a half wavelength of the fundamental wave and no shorter than a half wavelength of the second harmonic. As a result, the second harmonic magnetic fields are distributed so as to enter the additional regions 52*b* and 53*b* (52*c* and 53*c*). For this reason, the coupling windows 33*bc*3 and 33*bc*4 can each be provided at the position where the electric field energy of the second harmonic modes is high and electric field energy of the fundamental wave modes is low.

When a coupling window is provided at a position where the electric field energy of the fundamental wave modes is high, electric discharge is likely to occur at an opening of the coupling window or between the coupling window and a conductor side facing the coupling window. However, according to the first embodiment, this problem does not occur. Thus, power-withstanding capability does not deteriorate.

As described above, the harmonic propagation blocking filter 201 is a four-resonator filter in which the four resonators are sequentially connected. In the filter, the resonator section formed with the resonant region 51*b* and the resonator section formed with the resonant region 51*c* block the coupling and propagation of the second harmonic mode. In other words, the filter acts as a band-pass filter having a function to pass the fundamental wave frequency band and having a function to block the second harmonic.

Figure 6A:
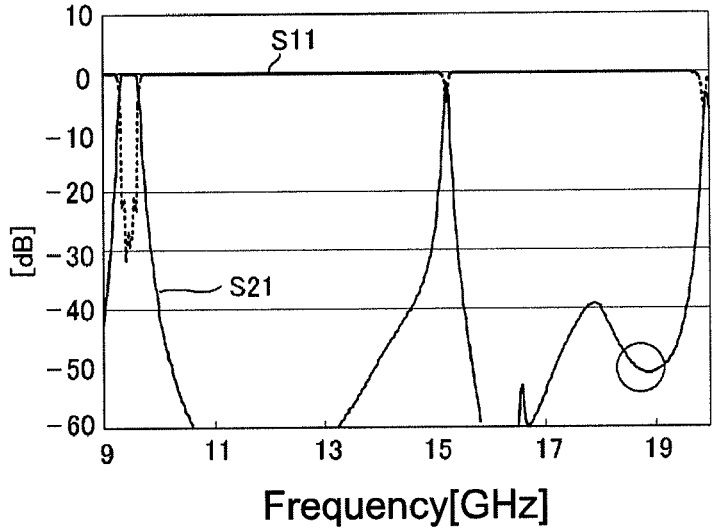
FIG. 6 shows a frequency characteristic of the harmonic propagation blocking filter.
Figure 6B:
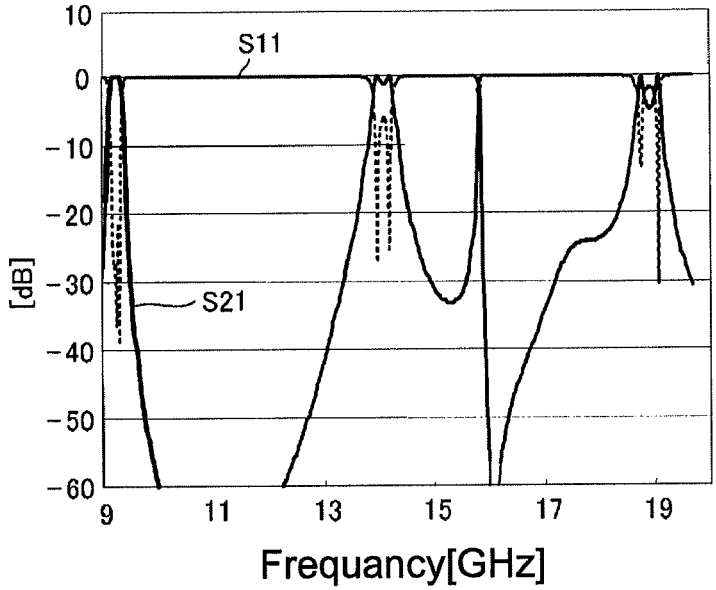

FIG. 6(A) shows a frequency characteristic of the harmonic propagation blocking filter according to the first embodiment. FIG. 6(B) shows a frequency characteristic of the filter shown in FIG. 4(B) of the comparison example. Both the frequency characteristics show that the fundamental wave frequency is 9.4 GHz. However, in the filter that does not have the harmonic blocking function, a passband occurs near 13.8 GHz and 18.8 GHz as shown in FIG. 6(B). On the other hand, in the harmonic propagation blocking filter according to the first embodiment, insertion loss is great at 18.8 GHz as indicated by a circle in FIG. 6(A). This indicates that the second harmonic is blocked.

Second Embodiment

Figure 7:
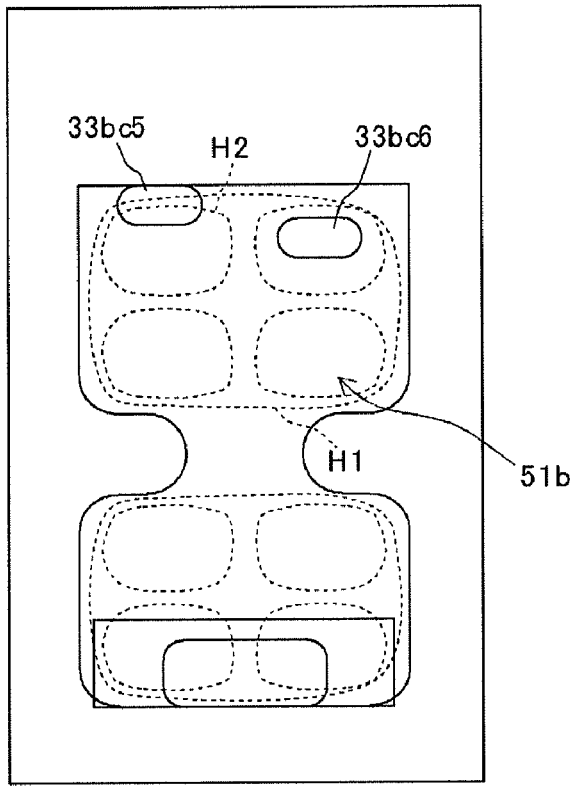
FIG. 7 is a plane view showing a structure of a main part of a harmonic propagation blocking filter according to a second embodiment.

A harmonic propagation blocking filter according to a second embodiment is, similarly to the harmonic propagation blocking filter according to the first embodiment, formed such that a partition plate is interposed between two metallic blocks. FIG. 7 is a plane view showing shapes of resonant regions and arrangement of coupling windows, which are included in the harmonic propagation blocking filter according to the second embodiment. This diagram is shown in a manner corresponding to that of FIG. 4(A) of the first embodiment.

In the example shown in FIG. 7, the additional regions 52*b* and 53*b* as shown in FIG. 4(A) are not provided. Only two coupling windows 33*bc*5 and 33*bc*6 are provided at the resonant region 51*b*.

In FIG. 7, the loop H1 indicated by a dashed line is a magnetic field loop in electromagnetic field distribution of a fundamental wave mode, and the four loops H2 indicated by dashed lines represent magnetic field loops in electromagnetic field distribution of a second harmonic mode. Similarly, the electromagnetic field distributions of the fundamental wave mode and the second harmonic mode are present in a resonant region adjoining the resonant region 51*b*, the resonant regions having the partition plate interposed therebetween.

Since the coupling window 33*bc*5 is positioned in an area where magnetic field energy of the fundamental wave modes of the two adjoining resonators is high, and the coupling window 33*bc*6 is positioned in an area where magnetic field energy of the fundamental wave modes of the two resonators is relatively high, the fundamental wave modes of the two resonators are magnetically coupled.

In the area in which the coupling window 33*bc*5 is positioned, magnetic field energy of the second harmonic modes of the adjoining resonators is also high. Accordingly, the second harmonic modes of the two resonators are prompted to be magnetically coupled. However, since the coupling window 33*bc*6 is positioned in the area where electric field energy of the second harmonic modes of the adjoining resonators is high, the second harmonic modes of the two resonators are prompted to be electrically coupled. By causing the amount of the electric field coupling between the second harmonic modes and the amount of the magnetic field coupling between the second harmonic modes to be substantially equal, the second harmonic modes of the adjoining resonators are rarely coupled.

As described above, the harmonic propagation blocking filter according to the second embodiment is a four-resonator filter in which four resonators are sequentially connected. In the filter, the resonator section formed with the resonant region 51*b* and the resonator section formed with the resonant region adjoining the resonant region 51*b* block the coupling and propagation of the second harmonic mode. In other words, the filter acts as a band-pass filter having a function to pass the fundamental wave frequency band and having a function to block the second harmonic.

Third Embodiment

Figure 8:
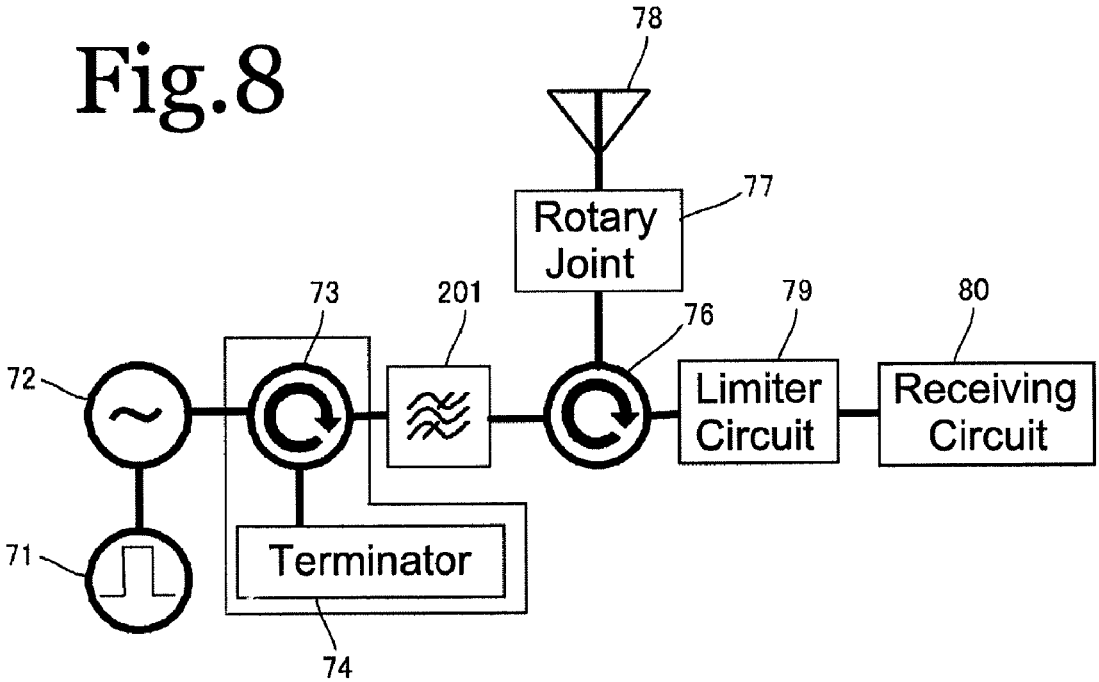
FIG. 8 is a block diagram showing a structure of a radar according to a third embodiment.

FIG. 8 is a block diagram showing a structure of a radar that is an example of a microwave transmitter according to a third embodiment. A high-frequency circuit section of the radar comprises: a magnetron 72 which oscillates to generate a microwave; a drive circuit 71 for pulse-driving the magnetron 72; a circulator 73 for propagating, to a subsequent stage, an oscillation signal generated by the magnetron 72; a terminator 74; the harmonic propagation blocking filter 201 for suppressing a second harmonic; a circulator 76 for propagating a transmission signal to a rotary joint side and propagating a received signal to a receiving circuit side; a rotary joint 77; an antenna 78; a limiter circuit 79 for limiting power of the transmission signal so as not to reach the receiving circuit side; and a receiving circuit 80.

As a result of the drive circuit 71 pulse-driving the magnetron 72, a pulse microwave signal of 9.4 GHz is outputted. Then, the signal propagated through the following path is radiated into the air: the circulator 73→the harmonic propagation blocking filter 201→the circulator 76→the rotary joint 77→the antenna 78. Meanwhile, the signal, which has reflected at a target, is received by the antenna 78, and the signal propagated through the following path is received: the rotary joint 77→the circulator 76→the limiter circuit 79→the receiving circuit 80.

When the transmission signal travels through the harmonic propagation blocking filter 201 in this manner, the second harmonic is blocked. Therefore, unnecessary radiation of the second harmonic from the antenna 78 is suppressed. Since the harmonic propagation blocking filter 201 is provided at a subsequent stage to the circulator 73, the harmonic propagation blocking filter 201 is effective to block not only the second harmonic occurring at the magnetron 72 but also the second harmonic occurring at the circulator 73.

Note that, the second harmonic, which reflects without being transmitted through the harmonic propagation blocking filter 201, reaches the terminator 74 through the circulator 73, and is then consumed at the terminator 74. Therefore, the magnetron 72 does not receive negative effect.

Note that, although in the above embodiments the resonant regions of the fundamental wave are each formed using a cavity resonator, the resonant regions are not necessarily filled with air, but may each be filled with a solid dielectric material. Alternatively, the resonant regions may each be formed by forming an electrode film on an exterior surface of a dielectric block. Waveguide resonators of the present invention may be formed in such a manner.

Further, in the above embodiments, coupling windows are provided at an H-plane that partitions adjoining waveguide resonators. However, the coupling windows may be provided at an E-plane in accordance with a positional relationship between the adjoining resonators. In other words, a plurality of coupling windows may be provided at any positions as long as, via a part or all of the plurality of coupling windows, fundamental wave modes of the adjoining resonators are coupled, and predetermined-order harmonic modes of the adjoining resonators are magnetically and electrically coupled so as to negate the coupling of the predetermined-order harmonic modes.

Fourth Embodiment

FIG. 9 shows a perspective view showing a fundamental structure of a harmonic suppression resonator according to a fourth embodiment, and shows an example of electromagnetic field distribution of each mode.

Figure 9A:
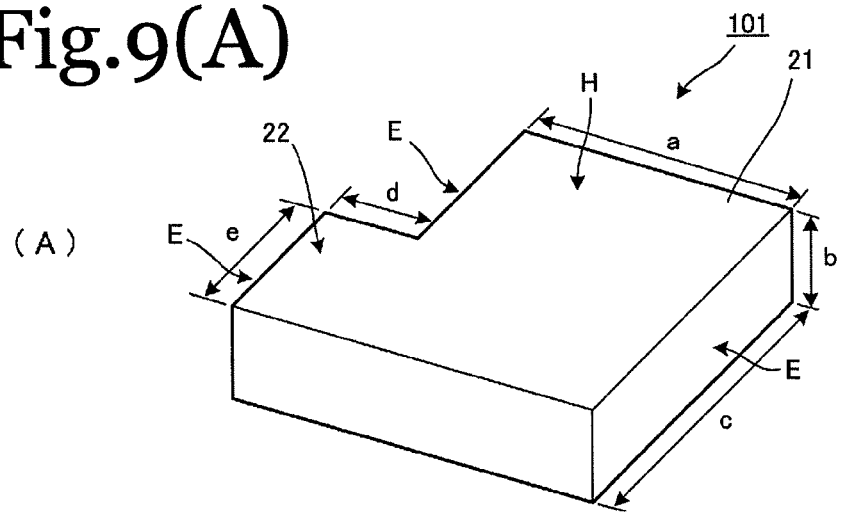
FIG. 9 shows a structure of a harmonic suppression resonator and an example of electromagnetic field distribution of each mode, according to a fourth embodiment.

As shown in FIG. 9(A), a harmonic suppression resonator 101 comprises a resonant region 21 and an additional region 22 that is a protruding portion of the resonant region 21. In FIG. 9, a plane indicated by "E" is an E plane, and a plane indicated by "H" is an H plane. This resonator may be seen as a cavity resonator that has an additional space therein.

The additional region 22 has such a shape as to be a partial protrusion of the E-plane of the resonant region 21 such that: a width, in a longitudinal direction of the E-plane of the resonant region 21, of the additional region 22 is no longer than ½ of a wavelength of a fundamental wave and no shorter than ½ of a wavelength of an n-th order harmonic; and a depth of the additional region 21 is substantially ¼ of the wavelength of the n-th order harmonic.

Figure 9B:
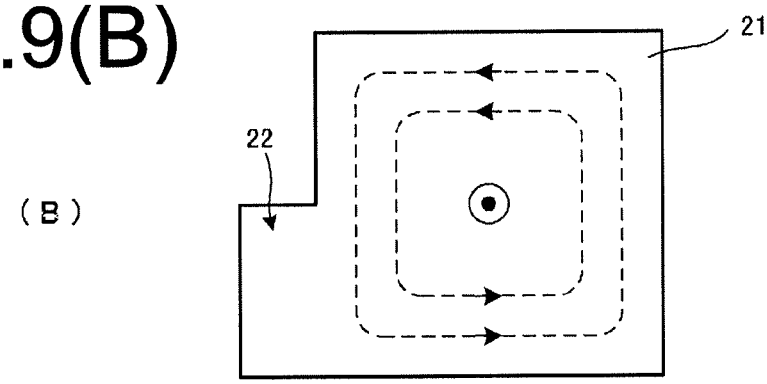
Figure 9C:
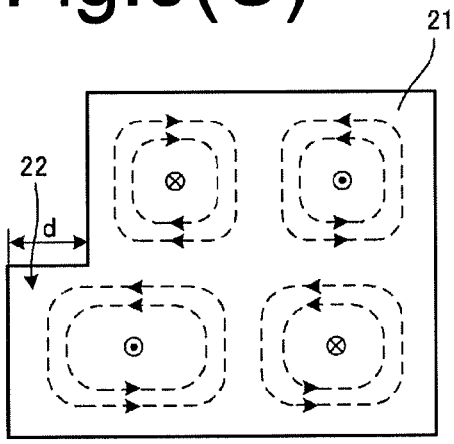

In the case where a frequency of the fundamental wave is 9.4 GHz, measurements of respective portions in FIG. 9(A) are as follows: a is 22.9 mm; b is 5 mm; c is 20 mm; d is 5 mm; and e is 10 mm. FIG. 9(B) shows electromagnetic field distribution of the fundamental wave, and FIG. 9(C) shows electromagnetic field distribution of a frequency-doubled wave mode (pseudo TE202 mode). Since the fundamental wave is blocked from entering the additional region 22, there is little change in a resonance frequency of the fundamental wave as shown in FIG. 9(B) even if there is the additional region 22. On the other hand, as shown in FIG. 9(C), the frequency-doubled wave enters the additional region 22. Therefore, the additional region 22 acts as a part of the resonant region. Consequently, an effective resonant space for the frequency-doubled wave is expanded, and the resonance frequency of the frequency-doubled wave becomes lower as compared to a case where the additional region 22 is not provided. Therefore, resonance does not occur at a second harmonic frequency (i.e., at a doubled frequency of the fundamental wave frequency).

Figure 9D:
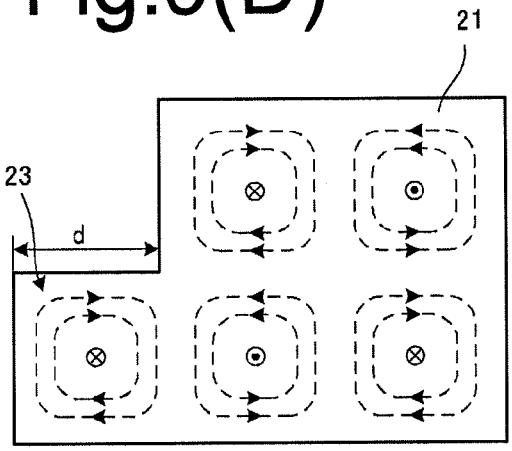

Note that, as shown in FIG. 9(D), if an additional region 23, which protrudes from the resonant region 21, is formed such that a depth of the additional region 23 is ½ of the wavelength of the second harmonic, standing waves as shown in FIG. 9(D) occur and resonance occurs at the doubled frequency of the fundamental wave. Therefore, it is crucial to properly set the measurement of the depth d of the additional region. The amount, by which the resonance frequency of the frequency-doubled wave becomes lower, is greatest when the measurement of the depth d is set to be substantially ¼ of the wavelength of the second harmonic. Accordingly, the second harmonic suppression effect is optimized.

FIG. 10 shows an example where an additional region 24 of the resonant region 21 is formed such that the center of the additional region 24 is positioned at an extension of a line that connects central positions, in a length direction along a longitudinal direction, of E-planes. In this case, as shown in FIG. 10, a frequency-doubled standing wave does not enter the additional region 24 sufficiently, and an effective resonant space is not expanded. Accordingly, the resonance frequency lowering effect for the second harmonic is small.

Therefore, the additional region 24 is provided such that the center of the additional region 24 deviates from the extension of the line that connects the central positions, in the length direction along the longitudinal direction, of the E-planes.

Fifth Embodiment

FIG. 11 is a perspective view showing a structure of a harmonic propagation blocking filter according to a fifth embodiment. Only a space where electromagnetic field distribution occurs is extracted from the filter and shown here. In FIG. 11, a harmonic propagation blocking filter 209 comprises three resonant regions 21*a*, 21*b* and 21*c*. Additional regions 22*a* and 22*c* are provided for the resonant regions 21*a* and 21*c*, respectively. Further, the harmonic propagation blocking filter 209 comprises input/output spaces 31*a* and 31*c*. A coupling window 35*aa* is provided between the input/output space 31*a* and the resonant region 21*a*. Similarly, a coupling window 35*cc* is provided between the input/output space 31*c* and the resonant region 21*c*. Further, a coupling window 35*ab* is provided between the resonant regions 21*a* and 21*b*, and a coupling window 35*bc* is provided between the resonant regions 21*b* and 21*c*.

As described above, a three-resonator filter is formed by sequentially connecting the three resonators that comprise the three resonant regions 21*a*, 21*b* and 21*c* and the additional regions 22*a* and 22*c*. This filter acts as a band-pass filter having a function to pass the fundamental wave frequency band and having a function to block the second harmonic.

Sixth Embodiment

FIG. 12 shows a perspective view of a main part of a harmonic propagation blocking filter 202 according to a sixth embodiment. FIG. 13 is an exploded plane view of components constituting the main part.

The harmonic propagation blocking filter 202 is basically formed with two metallic blocks 44 and 46, and with a partition plate 45 interposed therebetween.

Figures 13A, 13B, 13C:
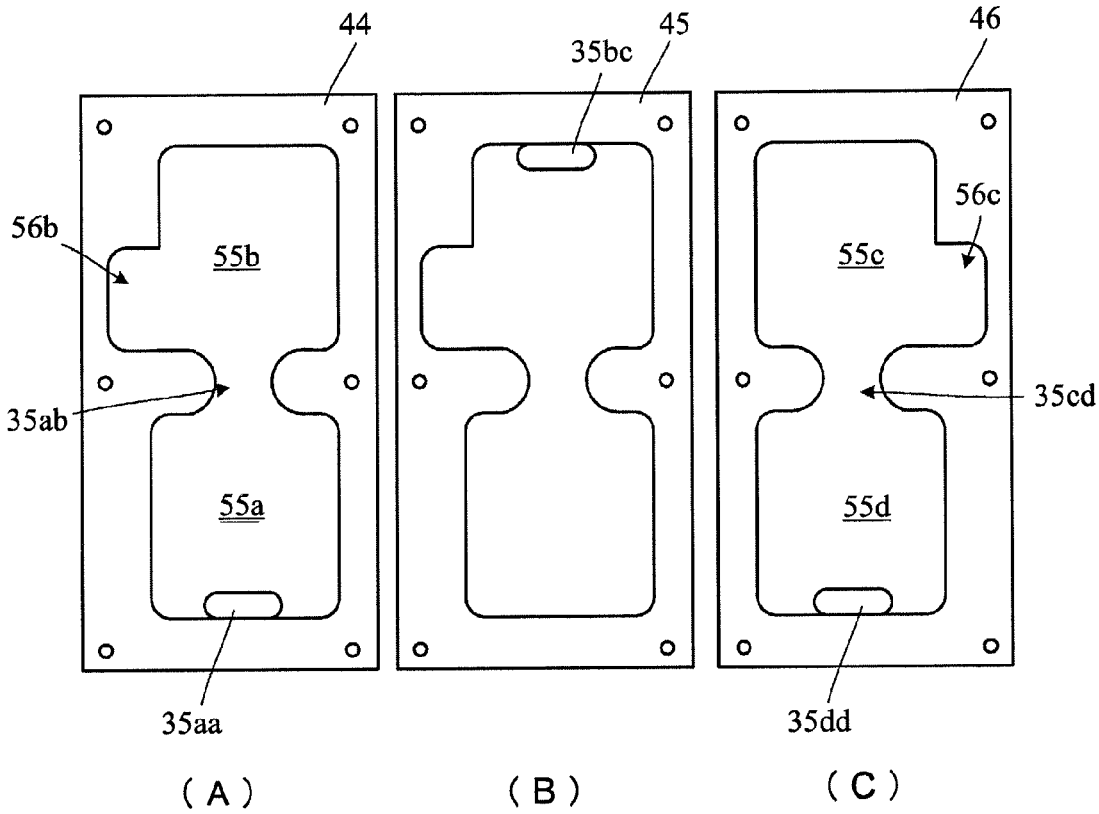
FIG. 13 is a plane view of components of the harmonic propagation blocking filter.

FIG. 13(A) is a plane view of the first metallic block 44. Recessed portions having a predetermined depth are formed on the first metallic block 44, whereby resonant regions 55*a* and 55*b* are formed on the first metallic block 44. An additional region 56*b* is provided at the resonant region 55*b*. A coupling window 35*ab* is formed between the two resonant regions 55*a* and 55*b*. Also, a coupling window 35*aa* is formed at the resonant region 55*a* so as to be open to rearward of FIG. 13(A).

Resonant regions 55*c* and 55*d*, an additional region 56*c*, and coupling windows 35*cd* and 35*dd* are formed on the second metallic block 46 such that the structure of the second metallic block 46 is mirror-symmetrical to that of the metallic block 44.

The partition plate 45 is a metallic plate interposed between resonant-region-forming planes of the metallic blocks 44 and 46, and have a coupling window 35*bc* that is an opening which allows the resonant regions 55*b* and 55*c* to communicate with each other.

Figure 12A:
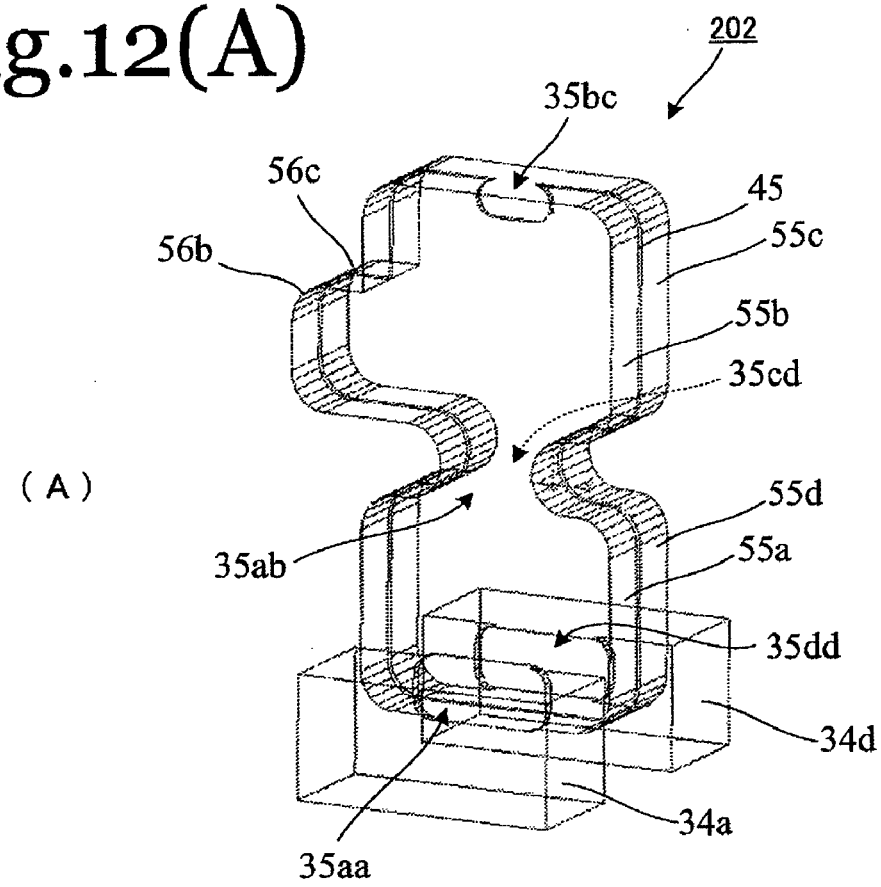
FIG. 12 shows a perspective view showing a main part of a harmonic propagation blocking filter according to a sixth embodiment, and shows an example of electromagnetic field distribution.

FIG. 12(A) shows resonant regions which are formed by combining the three components shown in FIG. 13 in a layered manner. Here, input/output spaces 34*a* and 34*d* are provided so as to be respectively connected to the coupling windows 35*aa* and 35*dd*. The input/output spaces 34*a* and 34*d* are end portions of a rectangular waveguide.

Owing to the above structure, an electromagnetic wave is propagated through the following path: the input/output space 34*a*→the coupling window 35*aa*→the resonant region 55*a*→the coupling window 35*ab*→(the resonant region 55*b*, the additional region 56*b*)→the coupling window 35*bc*→(the resonant region 55*c*, the additional region 56*c*)→the coupling window 35*cd*→the resonant region 55*d*→the coupling window 35*dd*→the input/output space 34*d*.

Figure 12B:
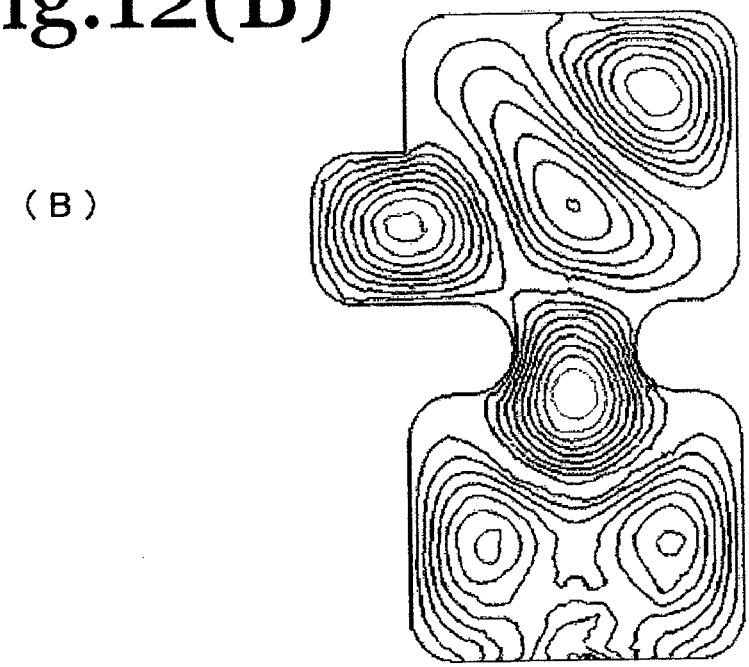

FIG. 12(B) shows density distribution of frequency-doubled standing waves occurring within the above resonant regions. As shown herein, a part of the frequency-doubled waves occurs in the additional regions 56*b* and 56*c*, and a resonance frequency of the frequency-doubled waves becomes lower than the twice of a fundamental wave frequency.

This filter is a four-resonator filter which is formed by sequentially connecting four resonators. In this filter, the resonator section, which is formed with the resonant region 55*b* and the additional region 56*b*, and the resonator section, which is formed with the resonant region 55*c* and the additional region 56*c*, block the resonance of the second harmonic.

In this manner, the filter acts as a band-pass filter having a function to pass the fundamental wave frequency band and having a function to block the second harmonic.

Figure 14A:
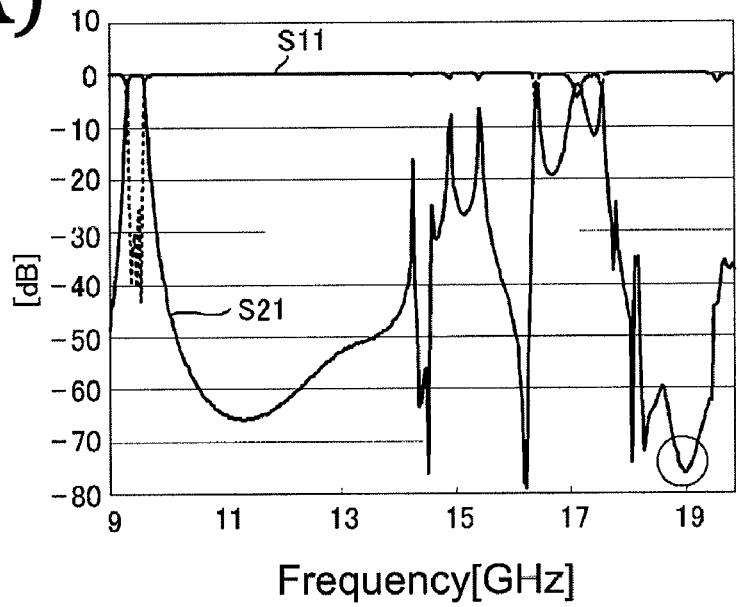
FIG. 14 shows a frequency characteristic of the harmonic propagation blocking filter.
Figure 14B:
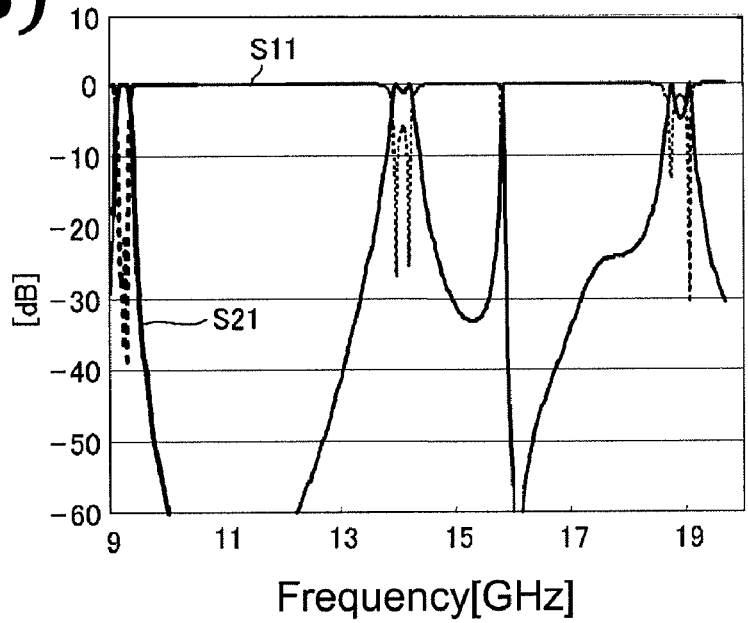

FIG. 14 shows a frequency characteristic of the harmonic propagation blocking filter shown in FIGS. 12 and 13, and shows a frequency characteristic of a filter in which the additional regions are not provided. FIG. 14(A) shows a characteristic of the harmonic propagation blocking filter according to the sixth embodiment. FIG. 14(B) shows, for comparison with the harmonic propagation blocking filter, a characteristic of the filter in which the additional regions 56*b* and 56*c* are not provided. Both the frequency characteristics show that the fundamental wave frequency is 9.4 GHz. However, in the filter that does not have the harmonic blocking function, a passband occurs near 13.8 GHz and near 18.8 GHz as shown in FIG. 14(B). On the other hand, in the harmonic propagation blocking filter according to the sixth embodiment, insertion loss is great at 18.8 GHz as indicated by a circle in FIG. 14(A). This indicates that the second harmonic is blocked.

Seventh Embodiment

Figure 15:
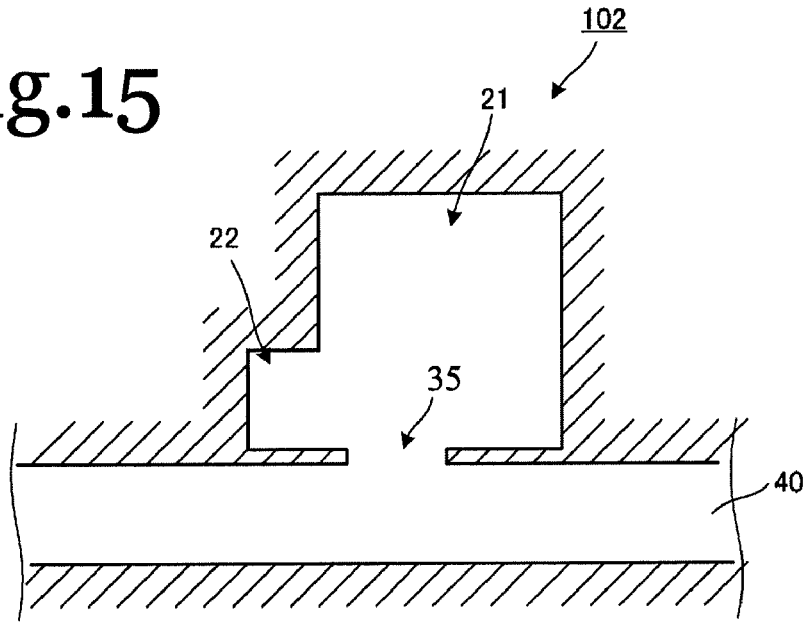
FIG. 15 is a horizontal sectional view showing a structure of a harmonic suppression resonator according to a seventh embodiment.

FIG. 15 is a horizontal sectional view showing a structure of a harmonic suppression resonator 102 according to a seventh embodiment. The harmonic suppression resonator 102 comprises the resonant region 21 and the additional region 22 which are described in the fourth embodiment. The resonant region 21 and the additional region 22 are formed within a metallic block. A waveguide section 40 is formed on the metallic block, and a coupling window 35 is provided between the resonant region 21 and a predetermined position of the waveguide section 40.

Owing to this structure, an electromagnetic wave propagating through the waveguide section 40 is, via the coupling window 35, coupled with the harmonic suppression resonator 102 that is formed with the resonant region 21 and the additional region 22. A fundamental wave is coupled with the harmonic suppression resonator 102, and almost the entire fundamental wave is reflected. Meanwhile, a second harmonic is not coupled with the harmonic suppression resonator 102. Therefore, the second harmonic is transmitted through the waveguide section 40. Thus, the harmonic suppression resonator 102 can be used as a circuit that traps a desired fundamental wave and which allows a second harmonic to be transmitted.

Eighth Embodiment

Figure 16:
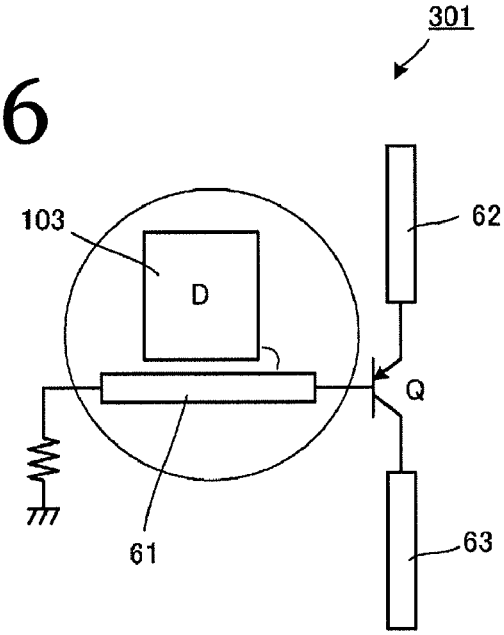
FIG. 16 is a circuit diagram of a harmonic suppression oscillator according to an eighth embodiment.

FIG. 16 is a circuit diagram of a harmonic suppression oscillator 301 according to an eighth embodiment. The harmonic suppression oscillator 301 comprises: a transmission line 61, one end of which is reflection-free terminated; a harmonic suppression resonator 103 coupled to the transmission line 61; an active element Q which acts as a negative resistance element to be coupled to a signal propagating through the transmission line 61; and stubs 62 and 63.

By having the above structure, the harmonic suppression oscillator 301 acts as a band-reflection oscillation circuit. The harmonic suppression resonator 103 resonates at a fundamental wave frequency and does not resonate at a second harmonic frequency. Accordingly, an oscillation signal having a high C/N ratio, which does not resonate at the second harmonic frequency and which does not cause a second harmonic component to occur, can be obtained. Note that, a mode, in which a frequency-doubled wave resonates, occurs in the harmonic suppression resonator 103. However, since the harmonic suppression resonator 103 is coupled with the transmission line 61 at such a position as to satisfy oscillation requirements at the fundamental wave frequency, the oscillation requirements are not satisfied at a resonance frequency of the aforementioned frequency-doubled wave. Consequently, a resonance frequency component of the frequency-doubled wave does not occur.

In the case where the transmission line 61 is formed with a waveguide, the harmonic suppression resonator 102 described in the seventh embodiment can be used as the harmonic suppression resonator 103.

Ninth Embodiment

Figure 17:
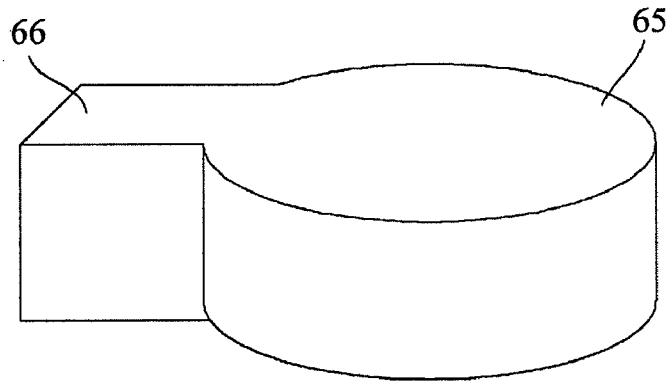
FIG. 17 shows a structure of a harmonic suppression resonator according to a ninth embodiment.

FIG. 17 is a circuit diagram of a harmonic suppression resonator according to a ninth embodiment. The harmonic suppression resonator is formed with a round-shaped resonant region 65 and an additional region 66. In the foregoing embodiments, the shape of the resonant regions of the fundamental wave is substantially rectangular parallelepiped. However, as shown in FIG. 17, the resonant regions of the fundamental wave may be in a cylindrical shape. A resonant mode of a fundamental wave of the resonant region 65 is TM○010 mode, and a resonant mode of a frequency-doubled wave of the resonant region 65 is TM○210 mode. Accordingly, a function and effect of the additional region 66 are the same as those shown in FIG. 9.

Tenth Embodiment

Figure 18:
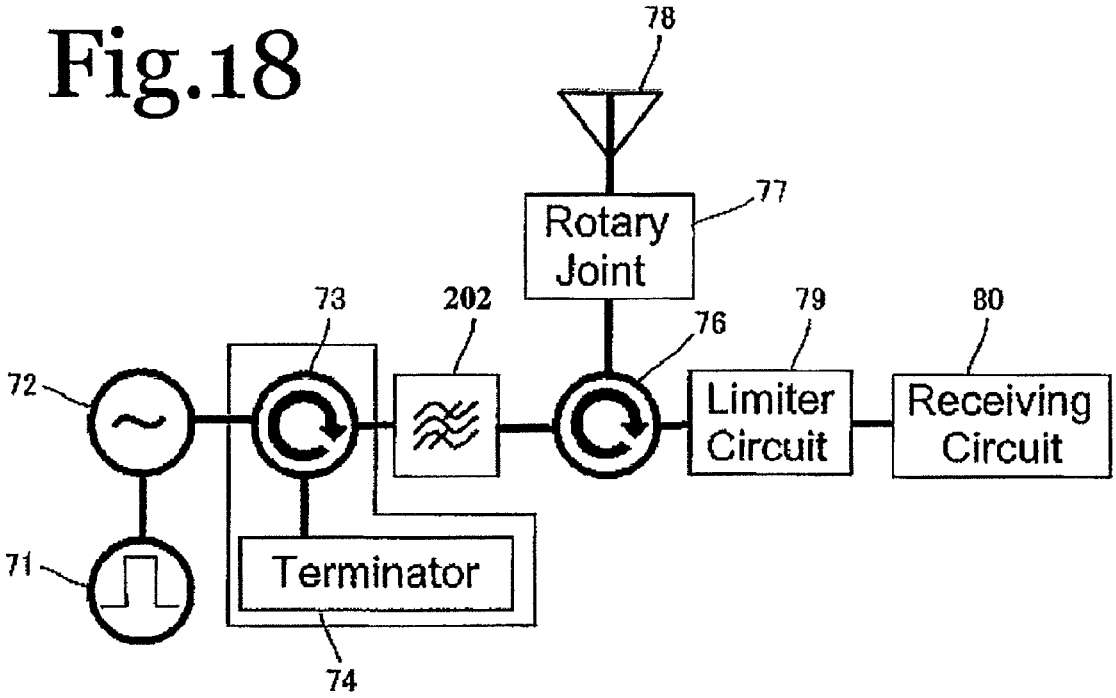
FIG. 18 is a block diagram showing a structure of a radar according to a tenth embodiment.

FIG. 18 is a block diagram showing a structure of a radar that is an example of a microwave transmitter according to a tenth embodiment. A high-frequency circuit section of the radar comprises: the magnetron 72 which oscillates to generate a microwave; the drive circuit 71 for pulse-driving the magnetron 72; the circulator 73 for propagating, to a subsequent stage, an oscillation signal generated by the magnetron 72; the terminator 74; the harmonic propagation blocking filter 202 for suppressing a second harmonic; the circulator 76 for propagating a transmission signal to a rotary joint side and propagating a received signal to a receiving circuit side; the rotary joint 77; the antenna 78; the limiter circuit 79 for limiting power of the transmission signal so as not to reach the receiving circuit side; and the receiving circuit 80.

As a result of the drive circuit 71 pulse-driving the magnetron 72, a pulse microwave signal of 9.4 GHz is outputted. Then, the signal propagated through the following path is radiated into the air: the circulator 73→the harmonic propagation blocking filter 202→the circulator 76→the rotary joint 77→the antenna 78. Meanwhile, the signal, which has reflected at a target, is received by the antenna 78, and the signal propagated through the following path is received: the rotary joint 77→the circulator 76→the limiter circuit 79→the receiving circuit 80.

When the transmission signal travels through the harmonic propagation blocking filter 202 in this manner, the second harmonic is blocked. Therefore, unnecessary radiation of the second harmonic from the antenna 78 is suppressed. Since the harmonic propagation blocking filter 202 is provided at a subsequent stage to the circulator 73, the harmonic propagation blocking filter 202 is effective to block not only the second harmonic occurring at the magnetron 72 but also the second harmonic occurring at the circulator 73.

Note that, the second harmonic, which reflects without being transmitted through the harmonic propagation blocking filter 202, reaches the terminator 74 through the circulator 73, and is then consumed at the terminator 74. Therefore, the magnetron 72 does not receive negative effect.

Note that, although in the above embodiments the resonant regions of the fundamental wave are each formed using a cavity resonator, the resonant regions are not necessarily filled with air, but may each be filled with a solid dielectric material. Alternatively, the resonant regions may each be formed by forming an electrode film on an exterior surface of a dielectric block. Waveguide resonators of the present invention may be formed in such a manner.

Eleventh Embodiment

Figure 19:
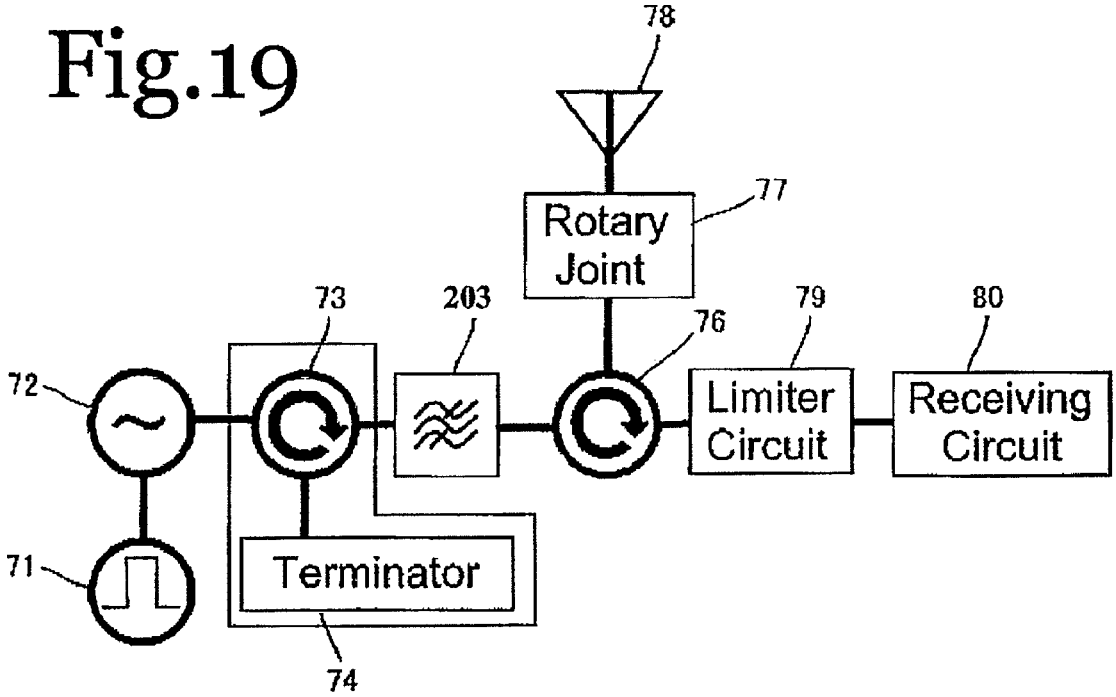
FIG. 19 is a block diagram showing a structure of a radar apparatus that is an example of a microwave transmission/reception apparatus in which a waveguide structure according to the present invention is applied.

FIG. 19 is a block diagram showing a structure of a radar apparatus as an example of a microwave transmission/reception apparatus in which a waveguide structure according to the present invention is applied. A high-frequency circuit section of the radar apparatus has the magnetron 72 that oscillates to generate, for example, a microwave of 9.4 GHz as a fundamental wave. The pulse-drive circuit 71 intermittently drives the magnetron 72 with a predetermined cycle, thereby causing the magnetron 72 to generate a pulse transmission signal having a predetermined width. The circulator 73 propagates the pulse transmission signal, which is provided from the magnetron 72, to a predetermined circuit side. The terminator 74 is connected to the circulator 73, and causes unnecessary power to be consumed. A filter 203 suppresses transmission of a harmonic of the fundamental wave. The suppressed harmonic reaches the terminator 74 via the circulator 73, and is then consumed at the terminator 74.

The circulator 76 is provided for propagating the transmission signal to a transmitting end and propagating a received signal to a receiving end. The rotary joint 77 is provided for electrically connecting a static system and a rotating system. The antenna 78 is caused by a motor (not shown) to rotate at a constant speed, and transmits to the outside the transmission signal as a radio wave pulse. The limiter circuit 79 suppresses a power signal level of a high level, which occurs immediately after reception has started, so as to protect the receiving circuit 80. The receiving circuit 80 receives a signal received by the antenna 78. Note that, the components from the magnetron 72 to the antenna 78, and the components from the antenna 78 to the limiter circuit 79, are formed with waveguides.

Figure 20A:
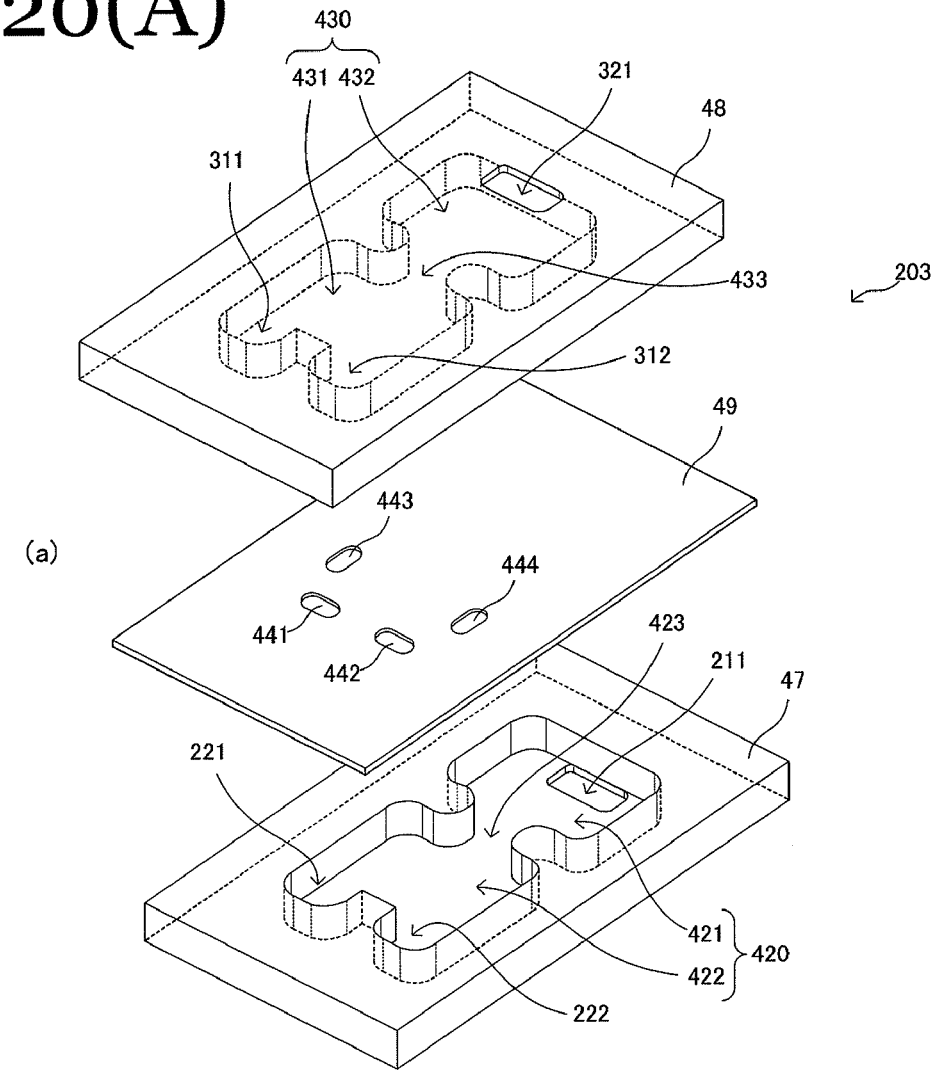
FIG. 20(A) is an exploded perspective view of a main part of a filter.
Figure 20B:
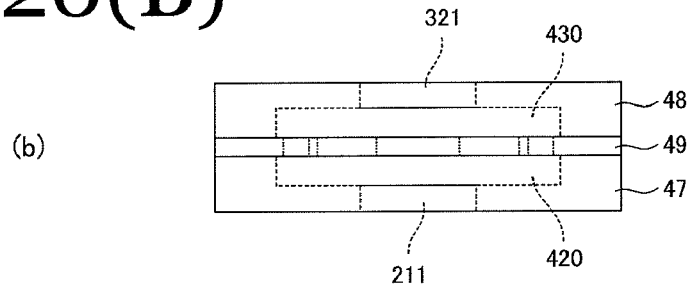
FIG. 20(B) is a side view showing that components of the main part are assembled.

FIG. 20(A) is an exploded perspective view of a main part of the filter 203. FIG. 20(B) is a side view showing that components of the main part are assembled. The filter 203 is formed with two metallic blocks 47 and 48, and with a partition plate 49 interposed there between. Note that, in the present embodiment, structures of the metallic blocks 47 and 48 are mirror-symmetric to each other.

The metallic block 47 is formed from conductive metal having a required thickness, such as aluminum (Al) or the like. A recessed portion (groove) 420, which has a predetermined depth that is determined based on a frequency of an electromagnetic wave to be used, is formed on an upper face (predetermined face) of the metallic block 47, which is a plane face portion. The recessed portion 420 has resonant regions 421 and 422. A coupling window 423 is formed between the resonant regions 421 and 422. A coupling window 211 is holed through the resonant region 421, as shown in the bottom part of FIG. 20. The coupling window 211 acts as an input port for an electromagnetic wave provided from an upstream side. Further, the resonant region 422 has additional regions 221 and 222.

The metallic block 48 is formed from conductive metal having a required thickness, such as aluminum (Al) or the like. A recessed portion (groove) 430, which has a predetermined depth that is determined based on a frequency of an electromagnetic wave to be used, is formed on a plane face portion at a lower face of the metallic block 48. The recessed portion 430 has resonant regions 431 and 432. A coupling window 433 is formed between the resonant regions 431 and 432. A coupling window 321 is holed through the resonant region 432, as shown in the upper part of FIG. 20. The coupling window 321 acts as an output port for an electromagnetic wave to be provided to a downstream side. Further, the resonant region 431 has additional regions 311 and 312. Note that, the positions of the coupling windows 211 and 321 are not limited to those shown in FIG. 20, but may be any positions that are favorable for the coupling windows 211 and 321 to act as input and output ports for the electromagnetic wave.

The partition plate 49 is conductive, and acts as a covering member for both the metallic blocks 47 and 48. Waveguide portions formed with the resonant regions 421, 422, 431, 432 and the partition plate 49, each act as a resonator in the present embodiment. Hardness of the partition plate 49 is preferred to be, at least, at a same level as that of the metallic blocks 47 and 48. More preferably, the partition plate 49 is softer than the metallic blocks 47 and 48. The partition plate 49 is formed from, for example, aluminum (Al). Alternatively, the partition plate may be formed by plating, with copper(Cu)-gold(Au) alloy, a surface of a base material. Four coupling windows 441 to 444 are holed through the partition plate 49 such that the coupling windows, each having a required shape, are respectively provided at required positions. Although not shown in FIG. 20, a required number of through-holes are drilled through the metallic blocks 47, 48 and the partition plate 49 so as not to drill through the recessed portions 420 and 430, such that the through-holes are aligned. Bolts are inserted into the through-holes and fastened by nuts with a required pressure, whereby the metallic blocks 47, 48 and the partition plate 49 are connected to each other, and thus a waveguide structure is formed. Fastening members for connecting the metallic blocks 47, 48 and the partition plate 49 with a required pressure, are not limited to bolts and nuts. Other publicly-known fastening members may be used.

Figure 21:
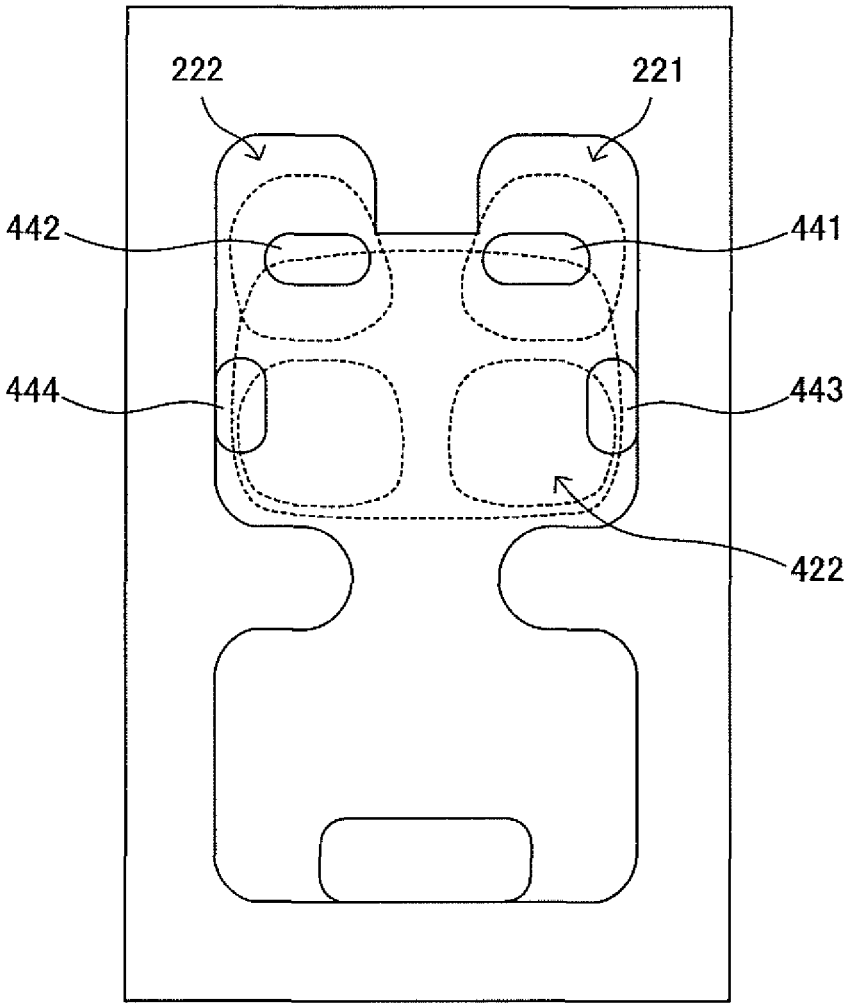
FIG. 21 is a plane view illustrating a positional relationship, in a resonant region, between electromagnetic field distribution and coupling windows.

FIG. 21 is a plane view illustrating a positional relationship, in a resonant region, between electromagnetic field distribution and the coupling windows 441 to 444.

As shown in FIG. 21, the coupling windows 441 to 444 are formed so as to be positioned in areas in each of which magnetic field energy of fundamental wave modes of the adjoining resonant regions 422 and 431 is high. For this reason, the fundamental wave modes of the resonant regions 422 and 431 are strongly magnetically coupled with each other. Meanwhile, the coupling windows 443 and 444 are formed so as to be positioned in areas in each of which electric field energy of second harmonic modes of the resonant regions 422 and 431 is high. For this reason, the second harmonic modes of the resonant regions 422 and 431 are prompted to be electrically coupled to each other.

However, the coupling windows 441 and 442 are formed so as to be positioned in the areas in each of which magnetic field energy of the second harmonic modes of the resonant regions 422 and 431 is high. For this reason, the second harmonic modes of the resonant regions 422 and 431 are prompted to be magnetically coupled to each other. By causing the amount of the electric field coupling between the second harmonic modes and the amount of the magnetic field coupling between the second harmonic modes to be substantially equal, the second harmonic modes of the resonant regions 422 and 431 are rarely coupled.

Note that, the additional regions 221 and 222 (311 and 312) each have such a shape as to be a partial protrusion of an E-plane of the resonant region 422 (431) such that a width, in a longitudinal direction of the E-plane, of each additional region is no longer than a half wavelength of the fundamental wave and no shorter than a half wavelength of the second harmonic. As a result, the second harmonic magnetic fields are distributed so as to enter the additional regions 221 and 222 (311 and 312). For this reason, the coupling windows 441 and 442 can each be provided at a position where the electric field energy of the second harmonic modes is high and electric field energy of the fundamental wave modes is low.

As described above, the filter 203 is a four-resonator filter in which the four resonators are sequentially connected. In the filter, the resonator corresponding to the resonant region 422 and the resonator corresponding to the resonant region 431 block the coupling and propagation of the second harmonic mode. In other words, the filter 203 has a function to pass the fundamental wave frequency band and a function to block the second harmonic. As shown in FIG. 6(A), the passband occurs near 13.8 GHz in relation to the fundamental wave frequency of 9.4 GHz. However, the second harmonic of 18.8 GHz is blocked.

Figure 22:
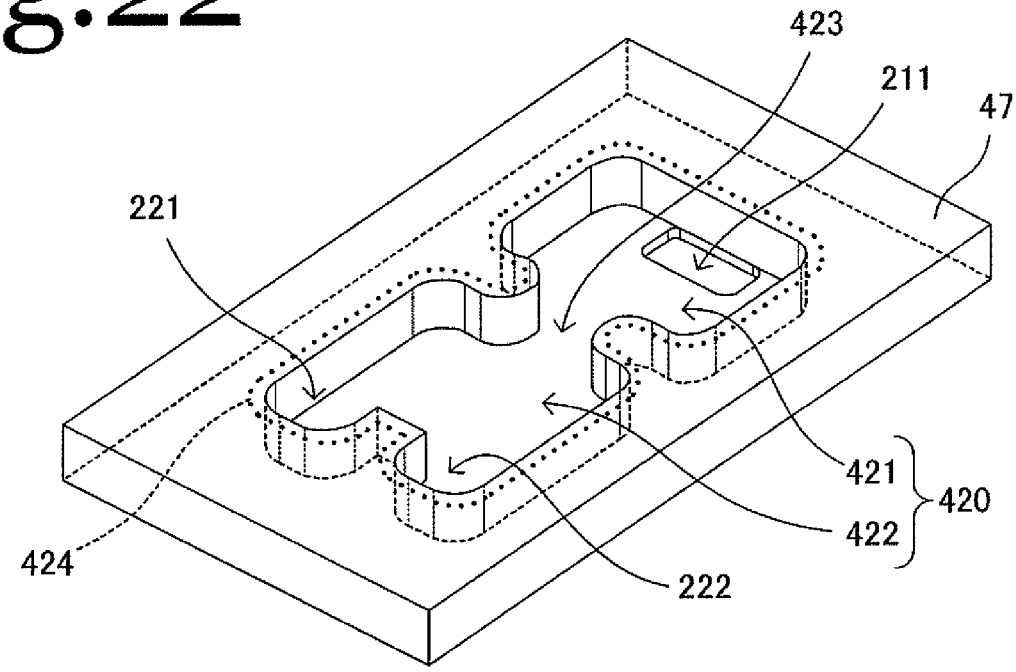
FIG. 22 illustrates a structure of an upper surface of a metallic block.

FIG. 22 illustrates a structure of an upper surface of at least one of the metallic blocks 47 and 48. Here, a structure of an upper surface of the metallic block 47 is described. In FIG. 22, a plurality of protrusions 424 are formed, along the recessed portion 420 with predetermined pitches, on the upper surface of the metallic block 47, which upper surface is a plane face portion. The protrusions 424 are positioned near the recessed portion 420. The predetermined pitches may be in a range of, at least, 0.5 mm to 4 mm. It has been discovered from an experiment that by using this range, radio wave leakage is favorably blocked.

Figure 23:
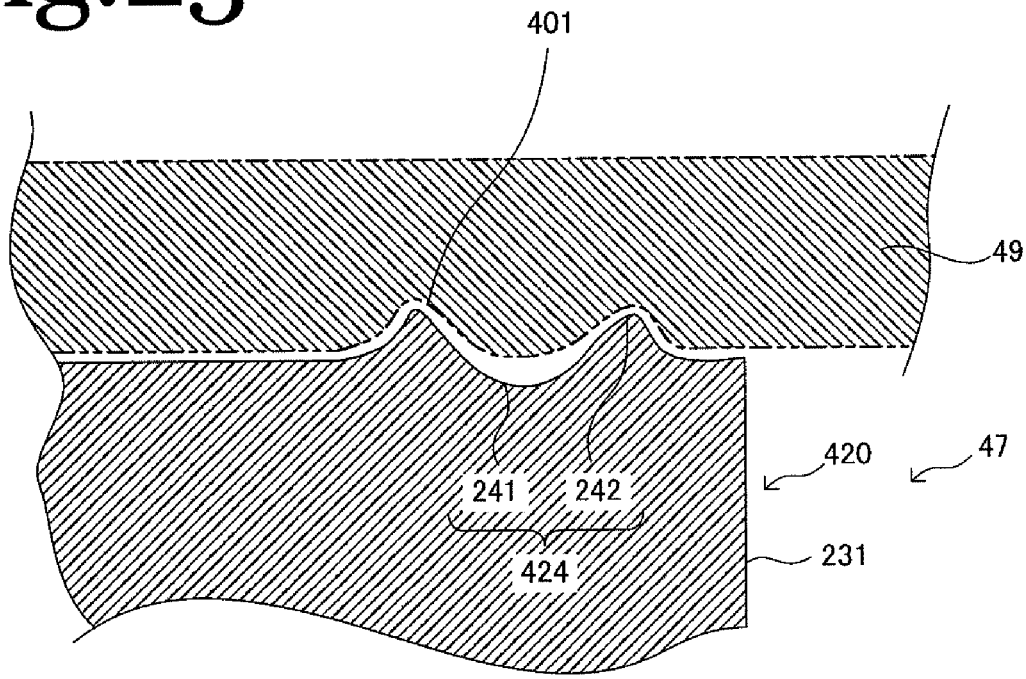
FIG. 23 shows cross-sectional shapes of protrusions and a partition plate.

FIG. 23 shows cross-sectional shapes of the protrusions 424 and the partition plate 49. The protrusions 424 shown in FIG. 23 are formed by punching. To be specific, a fine needle-shaped punching jig is pressed against the plane face portion of the metallic block 47 to form a recess 241, whereby swell portions 242 are formed around the recess 241. These swell portions 242 act as protrusions.

Figure 24:
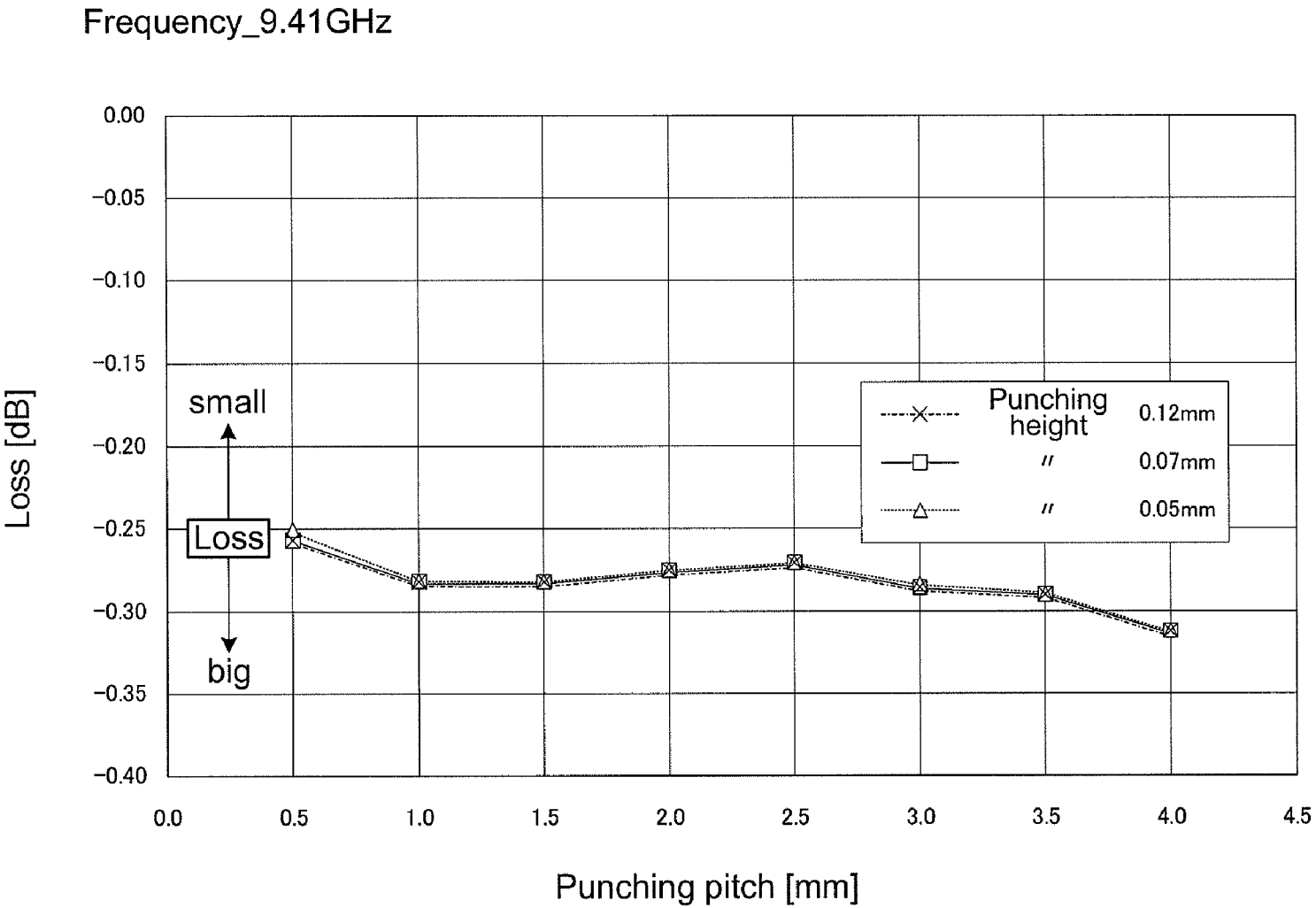
FIG. 24 shows a relationship between a height of the protrusions (a punching height) and a level of radio wave leakage.

A height of the swell portions 242 (i.e., a punching height) may be in a range of, at least, 0.05 mm to 0.12 mm. As shown in FIG. 24, by using this range, radio wave leakage can be favorably blocked. Thus, the amount of radio wave leakage is not greatly affected even if the height of the projected portion 242 varies in a wide range. Accordingly, precise fastening of the metallic blocks 47 and 48 with the partition plate 49 is not necessary.

The partition plate 49 is fastened, between the metallic blocks 47 and 48, by fastening members with a required pressure, and the partition plate is formed from a material which is as hard as, or preferably softer than, the metallic blocks 47 and 48. Therefore, the partition plate 49 is deformed, such as recesses 401, in accordance with the shape of the swell portions 242. Engagement between the swell portions 242 and the recesses 401 allows the metallic block 47 and the partition plate 49 to firmly and tightly contact each other, whereby a gap therebetween is eliminated. In addition, the engagement between the swell portions 242 and the recesses 401 maintains a fixed positional relationship between the metallic block 47 and the partition plate 49. Therefore, a gap due to displacement of the metallic block 47 and the partition plate 49 does not occur, and as a result, the radio wave leakage blocking function can be stabilized.

Twelfth Embodiment

The present invention may be in a form described below.

In the case where the protrusions 424 are provided on the metallic block 47, protrusions may also be formed on the metallic block 48. In this case, radio wave leakage can be prevented at both the recessed portions 420 and 430. Further, pitches and a height with which the protrusions are formed may be identical, or may be different, between the metallic blocks 47 and 48. The pitches may not necessarily be precisely constant. In the case where the pitches are set to be substantially identical between the metallic blocks 47 and 48, by forming the pitches such that positions of those formed on the metallic block 47 and positions of those formed on the metallic block 48 deviate from each other by half a pitch, the partition plate 49 is practically engaged with the metallic blocks every half a pitch. This increases a degree of contact between the partition plate 49 and the metallic blocks 47 and 48, and as a result, radio wave leakage is prevented more favorably.

Although the resonators, with which the filter is formed, have been described as one form of a waveguide structure, the present invention is not limited thereto. The present invention is similarly applicable in a microwave circuit element that propagates radio waves, such as a normal waveguide portion, flange portion, filter portion, or a circulator. It is conceivable that the radio waves, to which the present invention is applied, are mainly microwaves used by a ship radar or the like. However, the radio waves may be the one used by a vehicle-mounted obstacle detection radar or a vehicle-mounted anti-collision radar.

Figure 25:
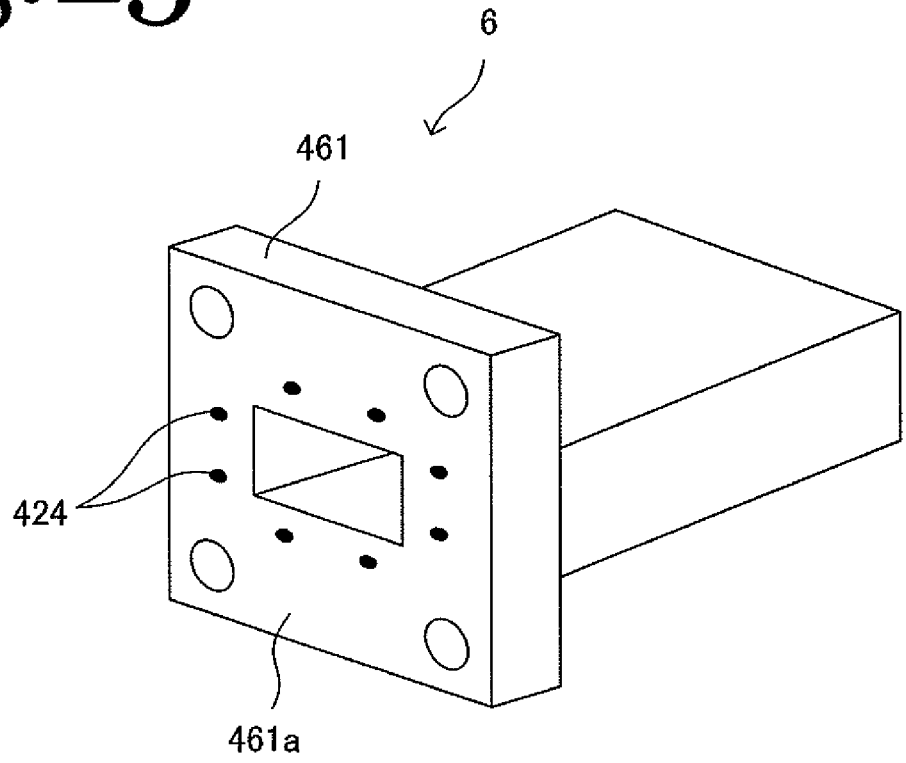
FIG. 25 is a partial structural view illustrating an embodiment where the present invention is applied to a flange portion of a waveguide.
Figure 26:
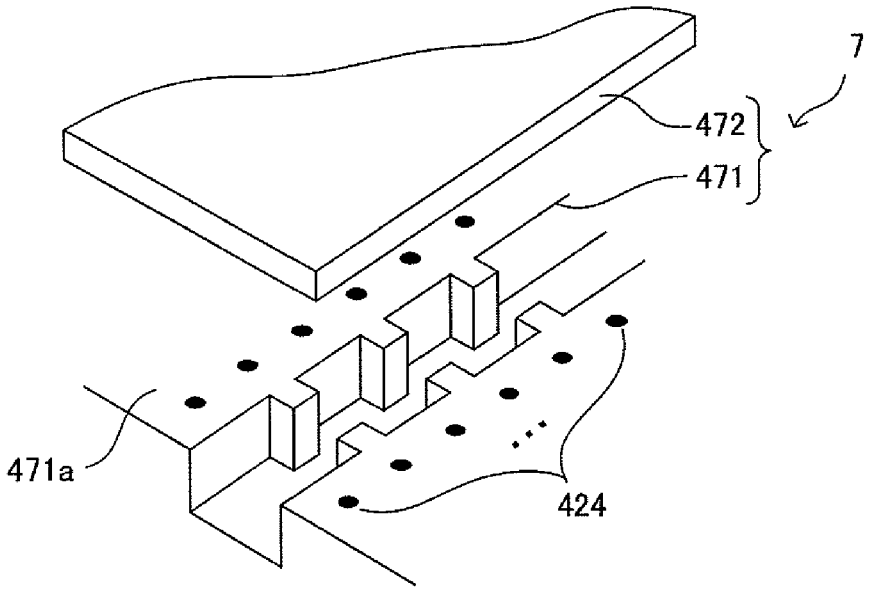
FIG. 26 is a partial structural view illustrating an embodiment where the present invention is applied to a filter.
Figure 27:
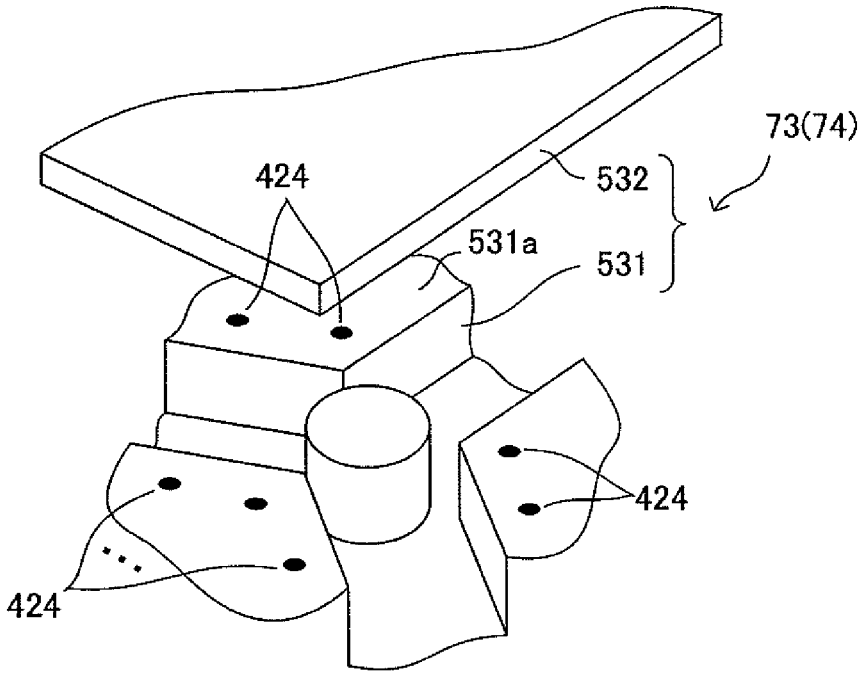
FIG. 27 is a partial structural view illustrating an embodiment where the present invention is applied to a circulator.
Figure 28:
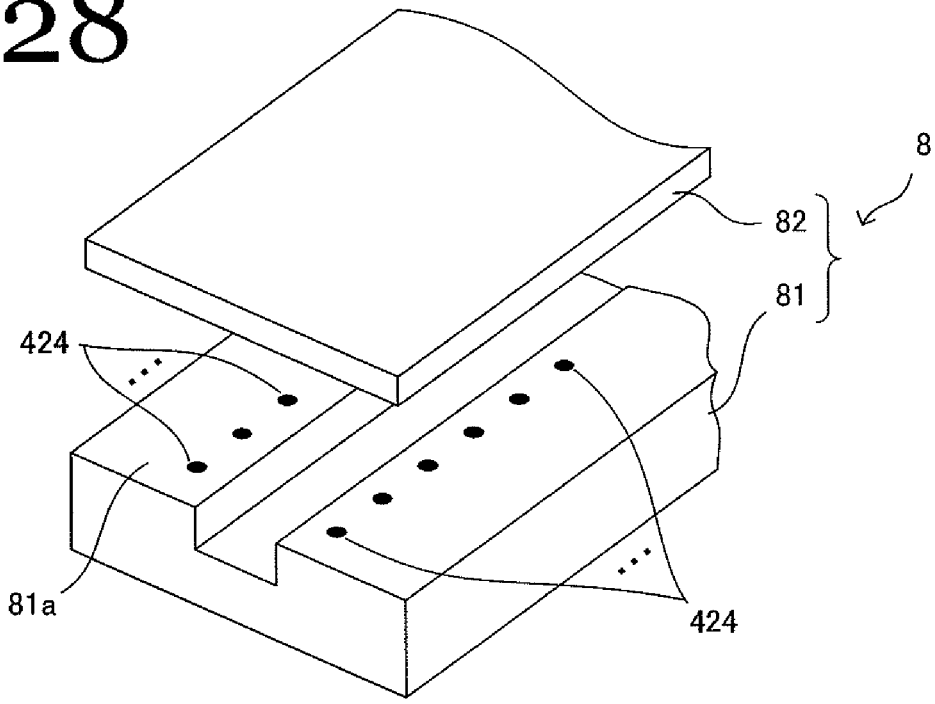
FIG. 28 is a partial structural view illustrating an embodiment where the present invention is applied to a normal waveguide.

FIG. 25 shows a joint surface 461*a* of a flange portion 461 of a waveguide 6, in which the protrusions 424 are formed near a waveguide path with predetermined pitches. FIG. 26 shows a filter 7 comprising: a waveguide section 471 in which a waveguide path is formed by digging a filter groove on a predetermined face 471*a* of one member; and a cover member 472 covering the predetermined face 471*a*. In the filter 7, the protrusions 424 are formed, on the predetermined face 471*a*, around the groove of the waveguide path with predetermined pitches. FIG. 27 is a circulator 73 (or 76) in which: a waveguide section 531 is formed by digging branched waveguide paths on a predetermined face 531*a* of one member 531; and the protrusions 424 are formed near the waveguide paths on the predetermined face 531*a* with predetermined pitches. FIG. 28 shows a waveguide 8 comprising: a waveguide section 81 in which a waveguide path is formed by digging a filter groove on a predetermined face 81*a* of one member; and a cover member 82 covering the predetermined face 81*a*. In the waveguide 8, the protrusions 424 are formed near the groove of the waveguide path on the predetermined face 81*a* with predetermined pitches.

Although it is described above that the protrusions 424 are formed by the punching process, the manner of forming the protrusions is not limited thereto. The protrusions may be formed by a different process, for example, a process in which pressure is applied to areas surrounding a central area so as to project the central area. In another form, the protrusions may be formed by bonding, or fusion-bonding, minute objects, e.g., sphere-shaped minute objects, to a plane face portion.

A distance from the protrusions 424 to a side wall 231 of the recessed portion 420 may be, as is clear from FIG. 23, in a range of a few tenths of a millimeter to a few millimeters. The protrusions 424, whose distance to the side wall 231 is within this range, are not too close to the side wall 231 to cause unnecessary deformation of the sidewall 231, and are not too distant from the sidewall 231 to deteriorate the radio wave leakage blocking capability.

While the invention has been described in detail, the foregoing description is in all aspects illustrative and not restrictive. It is understood that numerous other modifications and variations can be devised without departing from the scope of the invention.

What is claimed is:

1. A harmonic suppression resonator comprising:

a plurality of waveguide resonators respectively including resonant regions in each of which a fundamental wave resonates in TE mode, the harmonic suppression resonator having adjoining waveguide resonators therein coupled with each other via a coupling window, wherein harmonics of a predetermined order of the adjoining waveguide resonators are magnetically and electrically coupled with each other via the coupling window to weakened coupling of the harmonics.

2. The harmonic suppression resonator according to claim 1 further comprising:

a plurality of coupling windows, wherein fundamental waves of the adjoining resonators are mainly electrically or magnetically coupled with each other via a part or all of the plurality of coupling windows.

3. The harmonic suppression resonator according to claim 1 further comprising:

an additional region, whose width is no longer than a half wavelength of the fundamental wave and no shorter than a half wavelength of the harmonics, at any position on an E-plane of at least one of the plurality of waveguide resonators, wherein a first coupling window for causing the harmonics of the adjoining waveguide resonators to be magnetically coupled with each other; and a second coupling window for causing the harmonics to be electrically coupled with each other near the additional region.

4. The harmonic suppression resonator according to claim 1 further comprising:

an additional region whose size being configured to block the fundamental wave and to propagate an n-th order harmonic, wherein n is an integer no less than 2.

5. The harmonic suppression resonator according to claim 4, wherein the resonant regions respectively act as substantially rectangular waveguide resonators, in each of which the fundamental wave resonates in the TE mode; and the additional region has such a shape as to protrude from an E-plane of at least one of the substantially rectangular waveguide resonators such that a width, along a longitudinal direction of the E-plane, of the additional region is no longer than ½ of a wavelength of the fundamental wave and no shorter than ½ of a wavelength of the n-th order harmonic, and a depth of the additional region is different from m/2 of the wavelength of the n-th order harmonic, wherein m is an integer no less than 1.

6. The harmonic suppression resonator according to claim 5, wherein the depth of the additional region is substantially (1+2m)/4 of the wavelength of the n-th order harmonic, wherein m is an integer no less than 0.

7. The harmonic suppression resonator according to claim 4, wherein the additional region is provided such that a center of the additional region is positioned so as to deviate from an extension of a line that connects centers, in a longitudinal direction, of E-planes of at least one of the resonant regions.

8. The harmonic suppression resonator according to claim 1 further comprising:

a first metallic block with a radio wave-propagating groove on a side of the waveguide resonator and is covered with a plurality of first protrusions being formed on the side along the groove with the predetermined pitches.

9. The harmonic suppression resonator according to claim 8, wherein the cover member is formed from a material that is as hard as, or softer than, the first block.

10. The harmonic suppression resonator according to claim 8 further comprising:

a second block which is a metallic block provided to be positioned at an opposite side to the first block with respect to the cover member interposed between the second block and the first block and which has a radio-wave-propagating groove formed on a face thereof facing the cover member, wherein the second block has a plurality of second protrusions, formed on the face thereof facing the cover member, in positions along the groove with predetermined pitches.

11. The harmonic suppression resonator according to claim 10, wherein the grooves formed on the first and second blocks are mirror-symmetrical to each other, and positions of the first protrusions and positions of the second protrusions deviate from each other by substantially half a pitch.

12. The harmonic suppression resonator according to claim 10, wherein holes are drilled through the first block, the second block and the cover member such that the holes at respective faces of the first block, the second block and the cover member are aligned, and the first block, the second block and the cover member are fastened together with fastening means through the holes.

13. The harmonic suppression resonator according to claim 10, wherein the first and second protrusions are swell portions surrounding recesses that are formed by pressing operations performed with a needle-like body.

14. A harmonic propagation blocking filter comprising:

the harmonic suppression resonator according to claim 1; and input/output sections for guiding a propagation signal into/out of the resonant regions.

15. A radar apparatus comprising:

a magnetron which oscillates in $\pi$ mode to generate the fundamental wave;

an antenna; and the harmonic propagation blocking filter according to claim 14 on a propagation path between the magnetron and the antenna.

* * * * *